US010684008B2

(12) United States Patent
Kido et al.

(10) Patent No.: US 10,684,008 B2
(45) Date of Patent: Jun. 16, 2020

(54) EVAPORATION TYPE BURNER

(71) Applicant: SANGO CO., LTD., Miyoshi-shi, Aichi (JP)

(72) Inventors: Daisaku Kido, Miyoshi (JP); Yoshihiro Tsuchiya, Miyoshi (JP)

(73) Assignee: SANGO CO., LTD., Miyoshi-Shi, Aichi (JP)

( * ) Notice: Subject to any disclaimer, the term of this patent is extended or adjusted under 35 U.S.C. 154(b) by 250 days.

(21) Appl. No.: 15/561,307

(22) PCT Filed: Jun. 2, 2016

(86) PCT No.: PCT/JP2016/066498

§ 371 (c)(1),
(2) Date: Sep. 25, 2017

(87) PCT Pub. No.: WO2016/195046

PCT Pub. Date: Dec. 8, 2016

(65) Prior Publication Data

US 2018/0094806 A1 Apr. 5, 2018

(30) Foreign Application Priority Data

Jun. 2, 2015 (JP) ..... 2015-112599
Jun. 2, 2015 (JP) ..... 2015-112600
Jun. 2, 2015 (JP) ..... 2015-112601

(51) Int. Cl.
*F23D 3/40* (2006.01)
*F23Q 7/08* (2006.01)
(Continued)

(52) U.S. Cl.
CPC ..... *F23D 3/40* (2013.01); *F23L 1/00* (2013.01); *F23L 9/02* (2013.01); *F23Q 7/08* (2013.01)

(58) Field of Classification Search
CPC . F24C 5/02; B60H 1/2212; F23D 3/40; F23D 11/443; F23D 11/406;
(Continued)

(56) References Cited

U.S. PATENT DOCUMENTS 4,538,985 A 9/1985 Zwicker
5,056,501 A * 10/1991 Ida ..... B60H 1/2212 126/110 B
(Continued)

FOREIGN PATENT DOCUMENTS

CN 88102194 A * 12/1988 ..... B60H 1/2203
CN 101142016 B * 5/2010 ..... B01B 1/005
(Continued)

OTHER PUBLICATIONS

International Search Report (PCT/ISA/210) dated Aug. 16, 2016, by the Japanese Patent Office as the International Searching Authority for International Application No. PCT/JP2016/066498.
(Continued)

*Primary Examiner* — Steven B McAllister
*Assistant Examiner* — Daniel E. Namay
(74) *Attorney, Agent, or Firm* — Buchanan Ingersoll & Rooney PC

(57) ABSTRACT

A promotion member is disposed a predetermined distance apart from an impregnation member disposed at an upstream side end of a combustion chamber, and an ignition device and a first air supply opening are prepared on an upstream side from the promotion member in an ignition space, and a second air supply opening is prepared on a downstream side from the promotion member in the ignition space. Fuel is supplied to a smooth surface of the impregnation member, and a concave part or cutout is formed in the impregnation member to house at least a part of the ignition device. A flow rate of air supplied to the combustion space through the
(Continued)

second air supply opening becomes larger toward the downstream side. Thereby, ignitability in an evaporation type burner is improved and incomplete combustion of fuel on the downstream side of the combustion chamber is reduced.

14 Claims, 17 Drawing Sheets

(51) Int. Cl.
*F23L 1/00* (2006.01)
*F23L 9/02* (2006.01)

(58) Field of Classification Search
CPC .... F23D 11/448; F23D 11/46; F23D 2213/00; F23D 2900/05002; F23D 2900/21002; F23D 5/10; F23D 5/123; F23L 1/00; F23L 9/02; F23Q 7/08
USPC ..... 237/12.3 C; 431/7, 170
IPC ..... F23D 11/44,3/40, 5/10, 5/18; B60H 1/22 ; F24C 5/02
See application file for complete search history.

(56) References Cited

U.S. PATENT DOCUMENTS

| | | | | |
|---|---|---|---|---|
| 5,197,871 | A * | 3/1993 | Yamamoto | F23D 3/40 126/110 B |
| 5,617,995 | A | 4/1997 | Yasuda et al. | |
| 5,722,588 | A * | 3/1998 | Inoue | B60H 1/2209 237/12.3 C |
| 6,726,114 | B2 * | 4/2004 | Blaschke | B01B 1/005 237/2 R |
| 7,578,669 | B2 * | 8/2009 | Liu | F23C 13/06 122/367.1 |
| 9,857,081 | B2 * | 1/2018 | Collmer | B60H 1/2212 |
| 9,863,640 | B2 * | 1/2018 | Pfister | B60H 1/2203 |
| 9,897,311 | B2 * | 2/2018 | Collmer | B60H 1/2203 |
| 2003/0022118 | A1 * | 1/2003 | Suzuki | F23C 13/02 431/243 |
| 2003/0027090 | A1 * | 2/2003 | Blaschke | B01B 1/005 431/243 |
| 2004/0173682 | A1 | 9/2004 | Blaschke et al. | |
| 2008/0134580 | A1 * | 6/2008 | Kah | B01B 1/005 48/197 FM |
| 2008/0141675 | A1 * | 6/2008 | Liu | F23C 13/06 60/777 |
| 2015/0102115 | A1 * | 4/2015 | Collmer | B60H 1/2212 237/12.3 C |
| 2015/0102116 | A1 * | 4/2015 | Pfister | B60H 1/2203 237/12.3 C |
| 2015/0102117 | A1 * | 4/2015 | Collmer | B60H 1/2203 237/12.3 C |

FOREIGN PATENT DOCUMENTS

| | | | | |
|---|---|---|---|---|
| CN | 102200279 | B * | 9/2011 | |
| CN | 101589271 | B * | 1/2012 | F23C 13/06 |
| DE | 10019890 | A1 * | 10/2001 | F23D 11/404 |
| DE | 102004005267 | A1 * | 8/2005 | F23D 3/40 |
| DE | 102005003653 | A1 * | 8/2006 | F23D 3/40 |
| DE | 102005020147 | A1 * | 11/2006 | F23D 3/40 |
| DE | 102005032980 | B4 * | 4/2008 | F23D 3/40 |
| DE | 102009025593 | A1 * | 12/2010 | F23D 3/40 |
| DE | 102009044883 | A1 * | 6/2011 | F23D 3/40 |
| EP | 1696174 | A1 * | 8/2006 | F23D 3/40 |
| EP | 1 744 099 | A1 | 1/2007 | |
| EP | 1744099 | A1 * | 1/2007 | F23D 3/40 |
| EP | 1970624 | A2 * | 9/2008 | F23D 3/40 |
| EP | 2009352 | A2 * | 12/2008 | F23D 3/40 |
| EP | 1744100 | B1 * | 3/2014 | F23D 3/40 |
| EP | 1970624 | B1 * | 12/2016 | F23D 3/40 |
| JP | 59-60110 | A | 4/1984 | |
| JP | 59-217407 | A | 12/1984 | |
| JP | 02033522 | A * | 2/1990 | F23D 3/40 |
| JP | 2-140120 | | 11/1990 | |
| JP | 3-71217 | | 7/1991 | |
| JP | 7-110111 | A | 4/1995 | |
| JP | 07110111 | A * | 4/1995 | |
| JP | 7-133926 | A | 5/1995 | |
| JP | 2002-310405 | A | 10/2002 | |
| JP | 2002310405 | A * | 10/2002 | F23C 7/00 |
| JP | 2003-42409 | A | 2/2003 | |
| JP | 2003042409 | A * | 2/2003 | |
| JP | 2003-90512 | A | 3/2003 | |
| JP | 2003090512 | A * | 3/2003 | B01B 1/005 |
| JP | 2003-302009 | A | 10/2003 | |
| JP | 2004-37013 | A | 2/2004 | |
| JP | 2004037013 | A * | 2/2004 | |
| RU | 2310128 | C1 * | 11/2007 | F23D 3/40 |

OTHER PUBLICATIONS

Written Opinion (PCT/ISA/237) dated Aug. 16, 2016, by the Japanese Patent Office as the International Searching Authority for International Application No. PCT/JP2016/066498.

* cited by examiner

EVAPORATION TYPE BURNER

TECHNICAL FIELD

The present invention relates to an evaporation type burner.

BACKGROUND ART

An evaporation type burner in which a wick disposed at an end of a combustion chamber is impregnated with fuel and vapor of the fuel generated from the wick is heated by a glow plug disposed in the vicinity of the wick to be ignited and burned, has been known conventionally. Such an evaporation type burner is expected to be used as a heat source, for example, in a device aimed at regeneration of a diesel particulate filter (DPF) mounted on a vehicle, which uses diesel fuel, and heating of a vehicle and a residence, etc.

By the way, in an evaporation type burner, although an air supply opening for introducing air for burning fuel into a combustion chamber is prepared, a glow plug may be cooled by the introduced air and ignitability of the evaporation type burner may fall. Therefore, it has been proposed to prepare a windbreak member on an opposite side of a glow plug from a wick (namely, on a side of an air supply opening) to cover a part of the glow plug and thereby prevent the air introduced from an air supply opening into a combustion chamber from directly blowing on the glow plug to suppress decrease in ignitability of an evaporation type burner due to cooling of the glow plug (for example, refer to the Patent Document 1 (PTL1)).

Furthermore, it has been proposed to curve an element for evaporation (wick) so as to surround an ignition mechanism (glow plug) and thereby improve heat transfer to the element for evaporation from the ignition mechanism to improve ignitability of an evaporation type burner (for example, refer to the Patent Document 2 (PTL2)).

In addition, it has been proposed to incline a longitudinal direction of a slot (air supply opening) for introducing air into a combustion chamber with respect to an axis direction (longitudinal direction) of the combustion chamber to generate a swirl flow in the combustion chamber and thereby improve continuity of combustion in the combustion chamber (for example, refer to the Patent Document 3 (PTL3)).

CITATION LIST

Patent Literature

[PTL1] Japanese Patent Application Laid-Open (kokai) No. 2004-037013

[PTL2] Japanese Patent Application Laid-Open (kokai) No. 2003-302009

[PTL3] Japanese Patent Application Laid-Open (kokai) No. S59-060110

SUMMARY OF INVENTION

Technical Problem

In the combustion heater (evaporation type burner) described in the above-mentioned Patent Document 1 (PTL1), a windbreak member is prepared on an air supply opening side of a glow plug. As a result, there is a problem that a concentration fuel in the vicinity of the glow plug becomes excess with respect to air, and ignitability of the evaporation type burner may end up decreasing or a lifetime of a wick may become shorter due to unstable combustion.

Furthermore, in the evaporation type burner described in the above-mentioned Patent Document 2 (PTL2), since fuel is supplied to a curved part of the element for evaporation, there is a problem that it is difficult for fuel to permeate into the element for evaporation.

In addition, in the evaporation type burner described in the above-mentioned Patent Document 3 (PTL3), a width of a slot as an air supply opening is constant over its entire length in its longitudinal direction, and a connection part which connects an air-supply pipe for supplying air to the slot is formed on an upstream side (wick side) from the slot. Therefore, quantity of the air supplied to the combustion chamber through the slot becomes smaller toward the downstream side (opposite side from the wick), and there is a possibility that incomplete combustion of fuel may arise on the downstream side of the combustion chamber.

As mentioned above, in an evaporation type burner according to a conventional technology, there are first to third problems shown below. First, as the first problem, there is a problem to improve ignitability of an evaporation type burner and prolong a lifetime of a wick by supplying a suitable amount of air for ignition of fuel by an ignition device to the vicinity of the ignition device. Next, as the second problem, there is a problem to improve ignitability of an evaporation type burner by avoiding that permeation of fuel into a wick becomes difficult and improving heat transfer to a wick from an ignition mechanism. Furthermore, as the third problem, there is a problem to reduce shortage of air, which causes incomplete combustion of fuel on a downstream side of a combustion chamber.

Solution to Problem

The present invention has been conceived based on wholehearted research by the inventor in order to solve various problems which should be attained in an evaporation type burner according to a conventional technology, including the above-mentioned first to third problems. Summaries of evaporation type burners according to various aspects of the present invention will be mentioned below.

First Aspect of the Present Invention

In view of the above-mentioned first problem, an evaporation type burner according to a first aspect of the present invention (which may be referred to as a "first burner" hereinafter) comprises a combustion chamber, an impregnation member, a fuel supply unit and an ignition device.

The combustion chamber is a space defined by an inner side housing that is a bottomed cylindrical container consisting of a bottom wall and a peripheral wall. The impregnation member is a member disposed at a first end that is an end on said bottom wall side of said inner side housing in said combustion chamber and having a capillary structure and/or porous structure. The fuel supply unit is configured to supply fuel to said impregnation member and impregnate said impregnation member with said fuel. The ignition device is configured to heat and ignite vapor of said fuel evaporated from said impregnation member.

The first burner further comprises a promotion member. The promotion member is a member having many through-holes formed therein and being disposed a predetermined distance apart from said impregnation member on a second end side from said impregnation member in said combustion chamber. The second end is an end opposed to said first end of said combustion chamber.

Said ignition device is disposed so as to be exposed to an ignition space which is a space located on the first end side from said promotion member in said combustion chamber. Furthermore, a first air supply opening and second air supply opening are formed in said peripheral wall of said inner side housing. The first air supply opening is configured such that at least a part of said first air supply opening opens into said ignition space and supplies air to said ignition space. The second air supply opening is configured so as to open into a combustion space and supply air to said combustion space. The combustion space is a space located on said second end side from said promotion member in said combustion chamber.

Furthermore, in the first burner, said ignition device may be disposed so as to project upward from said peripheral wall of said inner side housing below a center in a vertical direction of said impregnation member in said ignition space in a state where said evaporation type burner is being used.

In addition, in the above-mentioned case, a leading end of said ignition device may be disposed so as to be located below the center in the vertical direction of said impregnation member in a state where said evaporation type burner is being used.

Second Aspect of the Present Invention

Next, in view of the above-mentioned second problem, an evaporation type burner according to the second aspect of the present invention (which may be referred to as a "second burner" hereinafter) is the above-mentioned first burner, wherein said fuel supply unit is configured so as to supply said fuel to a smooth surface formed on a surface on the first end side of said impregnation member. Furthermore, a concave part or cutout is formed in a region opposite to said ignition device of said impregnation member, and said ignition device is disposed such that at least a part of said ignition device is located within said concave part or said cutout.

Third Aspect of the Present Invention

Next, in view of the above-mentioned third problem, an evaporation type burner according to the third aspect of the present invention (which may be referred to as a "third burner" hereinafter) is the above-mentioned first or second burner, wherein said second air supply opening is constituted by either one or both of an air-supply aperture array and an air-supply slit.

The air-supply aperture array is at least one array of a plurality of apertures formed a predetermined distance apart from each other toward said second end side from said first end side in a predetermined region of said peripheral wall of said inner side housing which defines said combustion space. The air-supply slit is at least one slit formed so as to have a predetermined width and a predetermined length and extend toward said second end side from said first end side in a predetermined region of said peripheral wall of said inner side housing which defines said combustion space.

The third burner is configured such that a flow rate of air supplied to said combustion space through said second air supply opening on said second end side of said second air supply opening is larger than that on said first end side of said second air supply opening.

Furthermore, in the third burner, a plurality of said apertures constituting said air-supply aperture array may be configured such that an opening area of each aperture becomes gradually larger toward said second end side from said first end side. The width of said air-supply slit may be configured so as to become gradually larger toward said second end side from said first end side.

In addition, in the above-mentioned third burner, said air-supply aperture array may be configured such that an angle between a longitudinal direction of said air-supply aperture array and a direction parallel to an axis of said inner side housing is a predetermined angle. Said air-supply slit may be configured such that an angle between a longitudinal direction of said air-supply slit and a direction parallel to the axis of said inner side housing is a predetermined angle.

In the above, said air-supply aperture array may be configured such that an angle between a longitudinal direction of said air-supply aperture array and a direction parallel to the axis of said inner side housing changes toward said second end side from said first end side. Said air-supply slit may be configured such that an angle between a longitudinal direction of said air-supply slit and a direction parallel to the axis of said inner side housing changes toward said second end side from said first end side.

Furthermore, the above-mentioned third burner may further comprise an outside housing disposed on an outer periphery of said inner side housing, and an air-supply pipe which supplies air into said outside housing through a third air supply opening which is an aperture formed in a peripheral wall of said outside housing. In this case, an air-supply path which is a space whose both ends on said first end side and said second end side are closed is formed between said peripheral wall of said outside housing and said peripheral wall of said inner side housing. Said third air supply opening is formed on said second end side from said second air supply opening.

Fourth Aspect of the Present Invention

Next, an evaporation type burner according to the fourth aspect of the present invention (which may be referred to as a "fourth burner" hereinafter) is one of the above-mentioned first to third burners, wherein said promotion member is constituted by a member in a shape of a plate, which has a curved surface shape whose central part is convex to said first end side, and said impregnation member is also constituted by a member in a shape of a plate, which has a curved surface shape whose central part is convex to said first end side.

Fifth Aspect of the Present Invention

Next, an evaporation type burner according to the fourth aspect of the present invention (which may be referred to as a "fifth burner" hereinafter) is one of the above-mentioned first to third burners, wherein said promotion member comprises a projection part which is a part extending toward said first end side, and said projection part contacts with said impregnation member.

Furthermore, in the fifth burner, said projection part may be a bulge formed so as to be convex to said first end side in a part of said promotion member. In this case, said bulge contacts with said impregnation member by fitting in a concave part formed on said second end side of said impregnation member.

Sixth Aspect of the Present Invention

Next, an evaporation type burner according to the sixth aspect of the present invention (which may be referred to as a "sixth burner" hereinafter) is one of the above-mentioned first to third burners, wherein said promotion member is constituted by a plurality of promotion elements which are a plurality of constituent elements.

Each of said promotion elements comprises a primary part which is a part having a shape of a plate and a support part which is a part having a shape of a pillar or column extending in a normal direction of said primary part, and is independently fixed at a predetermined position by having said support part inserted into said impregnation member, respectively, and said through-holes of said promotion member are formed of gaps between said primary parts which said plurality of said promotion elements comprise.

Seventh Aspect of the Present Invention

Next, an evaporation type burner according to the seventh aspect of the present invention (which may be referred to as a "seventh burner" hereinafter) is one of the above-mentioned first to sixth burners, wherein said impregnation member is constituted by a laminated body including a plurality of layers which consist of a member having a capillary structure and/or porous structure, and coarseness of a layer exposed to said first end side is finer than coarseness of a layer exposed to said second end side, among said plurality of said layers which constitute said impregnation member.

Advantageous Effects of Invention

In accordance with the first burner, a suitable amount of air for ignition of fuel by the ignition device can be supplied to the vicinity of the ignition device through the first air supply opening. As a result, ignitability of the evaporation type burner can be improved and a lifetime of the wick can be prolonged.

In accordance with the second burner, fuel can be supplied to the smooth surface formed on the surface on the first end side of the impregnation member. As a result, fuel can permeate the inside of the impregnation member easily. Furthermore, in accordance with the second burner, the ignition device is disposed such that at least a part of the ignition device is located within the concave part or cutout formed in the region opposite to the ignition device of the impregnation member. As a result, heat transfer from the ignition device to the impregnation member can be improved. Thereby, ignitability of the evaporation type burner can be further improved.

In accordance with the third burner, the second air supply opening is constituted by either or both of the above-mentioned air-supply aperture array and air-supply slit, and it is configured such that the flow rate of the air supplied to the combustion space through the second air supply opening on the second end side (downstream side) of the second air supply opening is larger than that on the first end side (upstream side) of the second air supply opening. As a result, shortage of air on the downstream side of the combustion chamber can be reduced, and incomplete combustion of fuel can be reduced.

In accordance with the fourth burner, the promotion member is constituted by a member in a shape of a plate, which has a curved surface shape whose central part is convex to the first end side. As a result, as compared with a planar promotion member (in a shape of a plate), stiffness (section modulus) of the promotion member can be increased and deformation (thermal deformation) of the promotion member resulting from temperature change accompanying combustion of fuel can be reduced. On the other hand, the impregnation member is also constituted by a member in a shape of a plate, which has a curved surface shape whose central part is convex to the first end side. As a result, increase in distance between the promotion member and the impregnation member accompanying with the promotion member being constituted by the member in the shape of a plate, which has a curved surface shape, as mentioned above, can be reduced, and decrease in heat transfer from the promotion member to the impregnation member at the time of combustion of fuel can be reduced (which will be mentioned later in detail).

In accordance with the fifth burner, the promotion member comprises a projection part which is a part extending toward the first end side, and the projection part contacts with the impregnation member. As a result, heat transfer from the promotion member to the impregnation member at the time of combustion of fuel can be increased (which will be mentioned later in detail).

In accordance with the sixth burner, the promotion member is constituted by a plurality of promotion elements, each of which is fixed independently of each other at a predetermined position by its support part being inserted into the impregnation member. Since thermal deformation of each promotion element is small, thermal deformation as the whole promotion member accompanying combustion of fuel can be reduced.

In accordance with the seventh burner, the impregnation member is constituted by a laminated body including a plurality of layers which consist of a member having a capillary structure and/or porous structure, and coarseness of a layer exposed to the first end side is finer than coarseness of a layer exposed to the second end side. As a result, permeation of fuel in the impregnation member can be promoted on the first end side, and durability of the impregnation member against flame at the time of combustion of fuel can be raised on the second end side.

Although some embodiments of evaporation type burners according to various aspects of the present invention have been explained as mentioned above, other objectives, other features and accompanying advantages of the present invention will be easily understood from the following explanations about respective embodiments of the present invention described referring to drawings.

DESCRIPTION OF EMBODIMENTS

Working examples of an evaporation type burner according to various embodiments of the present invention will be explained in detail below, referring to drawings.

Working Example 1

Configuration

Figure 1:
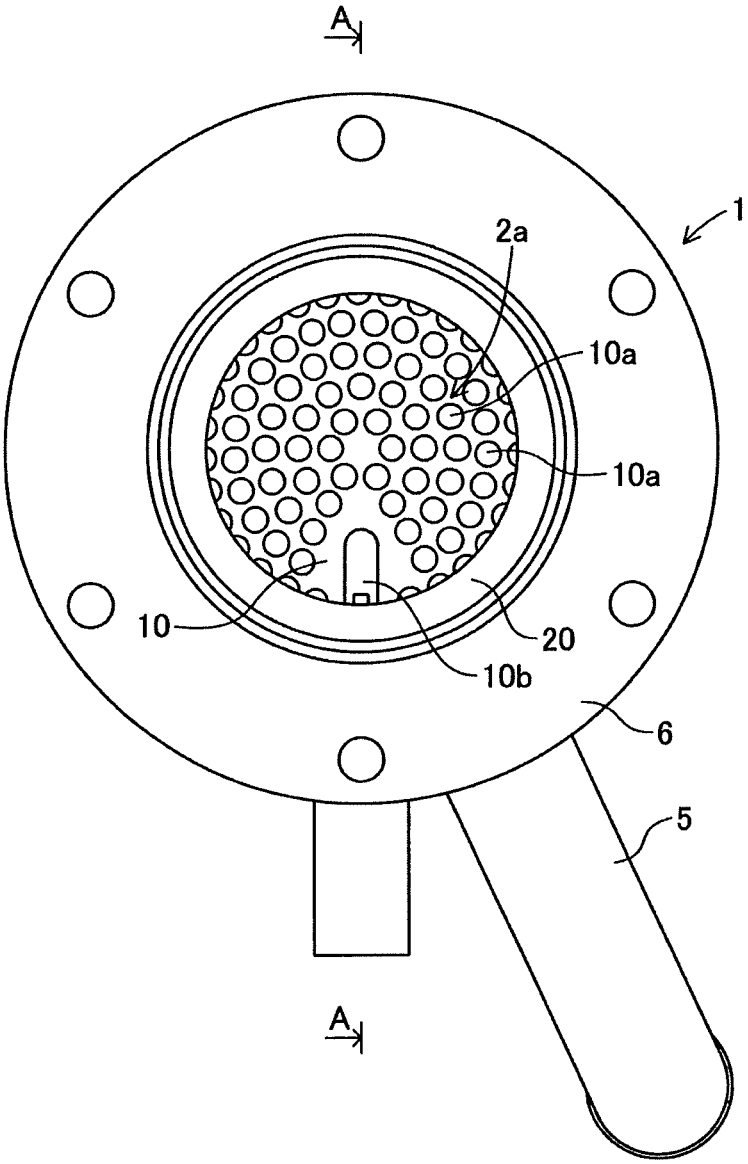
FIG. 1 is a schematic view for showing an evaporation type burner according to Working Example 1 of the present invention observed from its downstream side.
Figure 2:
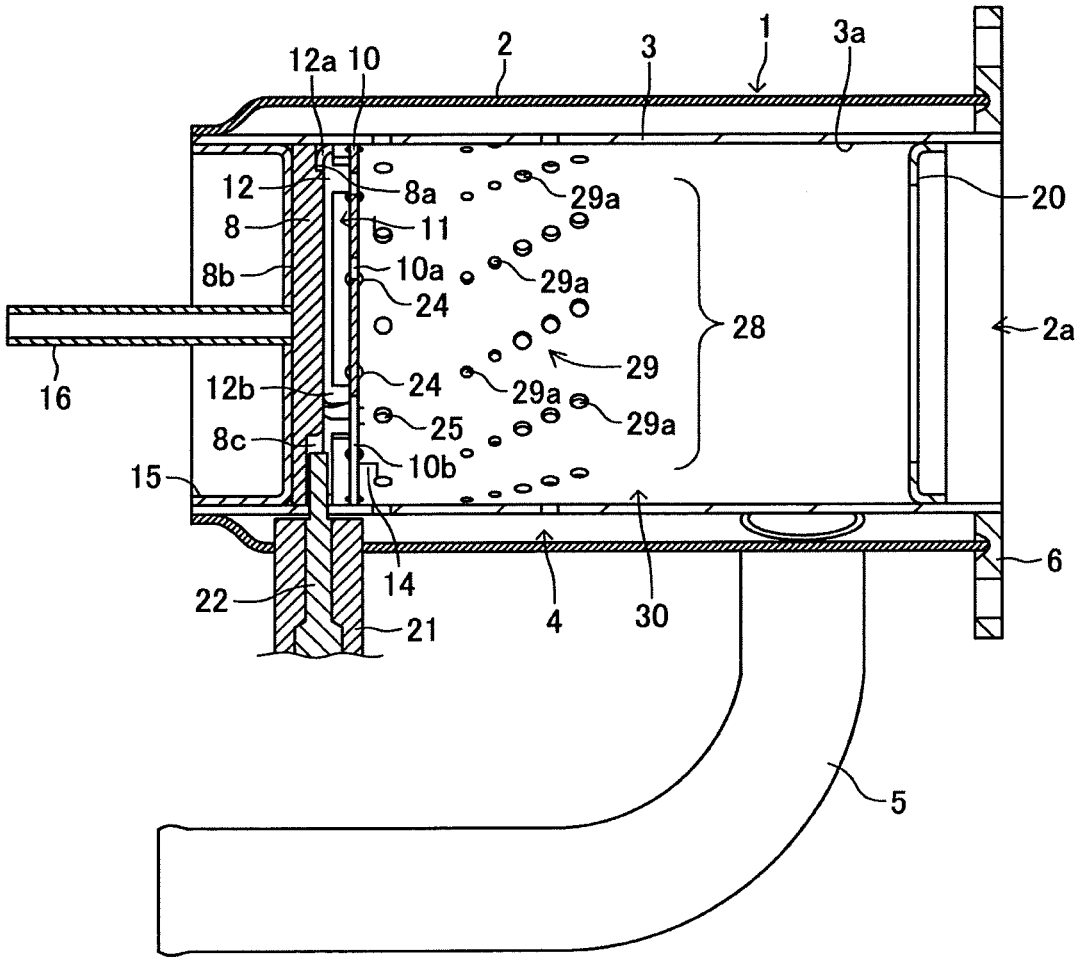
FIG. 2 is an A-A line sectional view of FIG. 1.

FIG. 1 is a schematic view for showing an evaporation type burner according to Working Example 1 of the present invention observed from its downstream side. FIG. 2 is an A-A line sectional view of FIG. 1. In the following explanation, an upper side in a vertical direction in a state where the evaporation type burner 1 is being used (for example, a status where it is mounted on a vehicle, etc.) will be referred to as an "upside" and a lower side which is opposite side thereto will be referred to as a "downside." Furthermore, a left-hand side when facing a paper surface of FIG. 2 will be referred to as an "upstream side" and a right-hand side which is opposite side thereto will be referred to as a "downstream side."

The evaporation type burner 1 comprises an outside housing 2 and an inner side housing 3 disposed inside the outside housing 2. Shapes of the outside housing 2 and the inner side housing 3 are not limited in particular, and can be designed suitably according to an intended use and operating environment, etc. of the evaporation type burner 1, for example. In the present working example, the outside housing 2 is formed as a cylindrical peripheral wall and the inner side housing 3 has been formed as a bottomed cylindrical container consisting of a bottom wall 15 and a cylindrical peripheral wall 3*a* coaxial with the peripheral wall of the outside housing 2. In the present working example, the bottom wall 15 is constituted by a "holding member" which will be mentioned later. Therefore, the bottom wall 15 may be referred to as a "holding member 15" in the following explanation.

Between the peripheral wall of the outside housing 2 and the peripheral wall of the inner side housing 3, an air-supply path 4 which is a space whose both ends on its upstream side and downstream side are closed is formed. A third air supply opening which is an aperture formed in the peripheral wall of the outside housing 2, and an air-supply pipe 5 is connected to this third air supply opening such that air is supplied to the air-supply path 4 within the outside housing 2 by an air-supply means which is not shown. A flow rate control part, which is not shown, is configured to be able to arbitrarily control a flow rate of the air supplied to the air-supply path 4.

A layer of the air supplied through the air-supply path 4 formed between the peripheral wall of the outside housing 2 and the peripheral wall of the inner side housing 3 as mentioned above can function as a heat insulating layer. As a result, heat in a combustion chamber 30 can be prevented from conducting to the outside housing 2 at the time of combustion of fuel to have an influence due to heat to an installation other than the evaporation type burner 1, etc.

A mounting member 6 which consists of a flange etc. is prepared so as to project outward at an end on the downstream side of the outside housing 2.

The combustion chamber 30 is a space defined by the inner side housing 3. An impregnation member 8 is disposed at a first end that is an end on a side of a holding member 15 which constitutes a bottom wall of the inner side housing 3 in the combustion chamber 30 (upstream side). Therefore, substantially, a space on a downstream side from the impregnation member 8 of an inside space of the inner side housing 3 corresponds to the combustion chamber 30. On the other hand, a second end (downstream side end) which is an end on an opposite side to the first end (upstream side end) of the inner side housing 3 is opened as an aperture 2*a*.

The impregnation member 8 is formed of material which has heat resisting properties, chemical stabilities (for example, corrosion resistant properties, etc.) against fuel and flexibility and can be impregnated with fuel in its inside. Specifically, the impregnation member 8 is a member formed of metal and/or ceramic material, etc., for example, and having a capillary structure and/or porous structure. In the present working example, a wick formed by packing metal fiber and/or ceramic fiber is used as the impregnation member 8.

Figure 3:
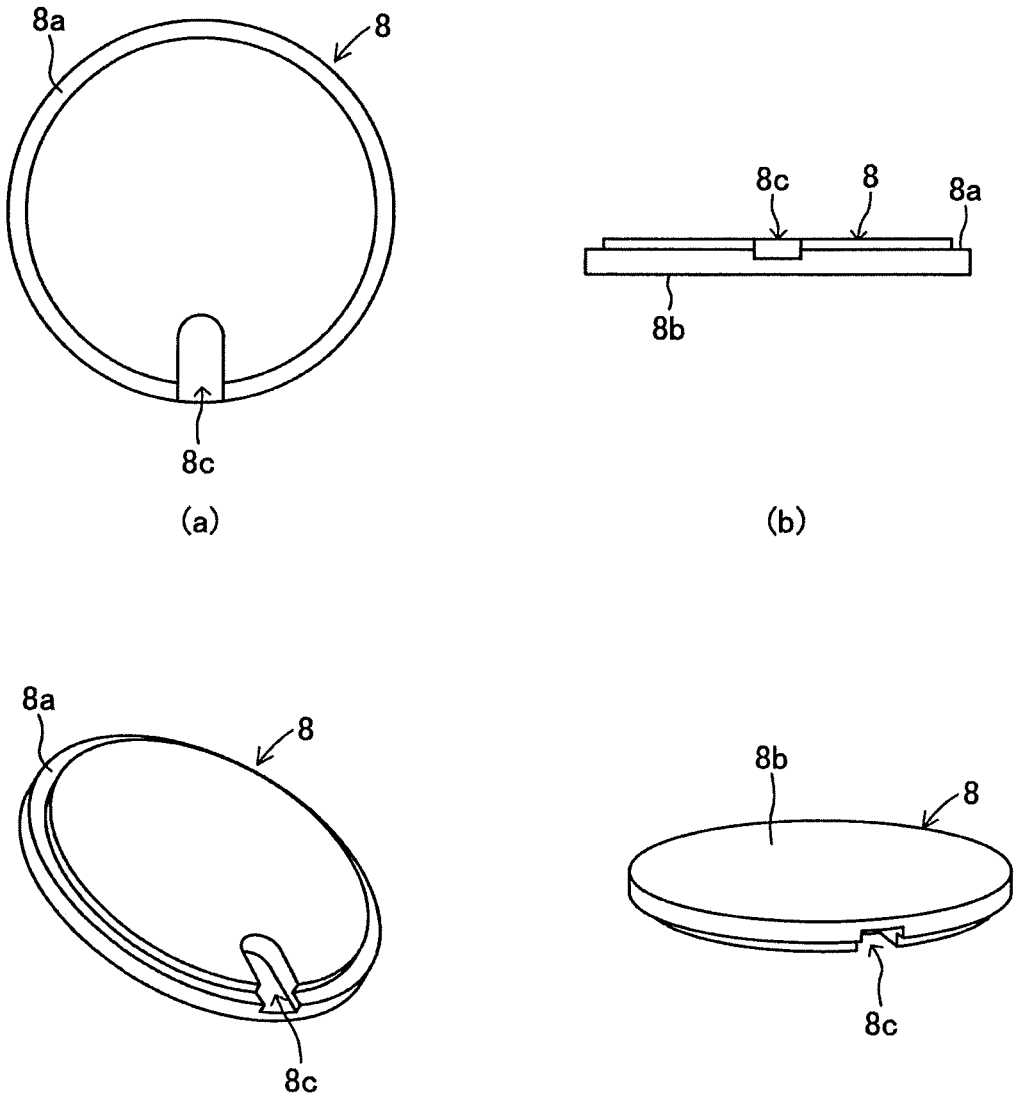
FIG. 3 is a schematic view for showing a configuration of an impregnation member used for an evaporation type burner according to Working Example 1 of the present invention, including (a) a front view observed from a downstream side, (b) a bottom view of (a), (c) a perspective view observed from the downstream side, and (d) a perspective view observed from an upstream side.

Moreover, the impregnation member 8 is formed approximately in a shape of a disc, and prepared so as to cover the whole cross-section of the combustion chamber 30 in a plane intersecting perpendicularly with an axis of the inner side housing 3. In the impregnation member 8 in the present working example, as shown in FIG. 2 and FIG. 3, a concave step part 8*a* is formed all over a periphery part (outer edge part) of a principal surface on its downstream side, and a region other than the step part 8*a* and a concave part 8*c*, which will be mentioned later, is formed planar. On the other hand, a principal surface 8*b* on an upstream side of the impregnation member 8 is formed as a smooth surface which consists of a flat surface or a curved surface (without unevenness). In the present working example, the principal surface 8*b* on the upstream side of the impregnation member 8 is formed as a flat surface. Thereby, as compared with a case where an impregnation member (element for evaporation) is curved so as to surround an ignition device (glow plug) as an evaporation type burner according to a conventional technology described at a beginning of the present specification, it becomes easier to fabricate an impregnation member, and its manufacturing process can be simplified and its manufacturing cost can be reduced.

As shown in FIG. 3, the concave part 8*c* toward an inner side (center side) from an outer edge of the impregnation member 8 is formed in a lower part of the principal surface on the downstream side of the impregnation member 8 (second end side). The concave part 8*c* is opened to the outside in a radial direction and the downstream side of the impregnation member 8. The concave part 8*c* can be formed in any shapes as long as at least a part of an ignition device 22, which will be mentioned later, is housed therein.

Figure 4:
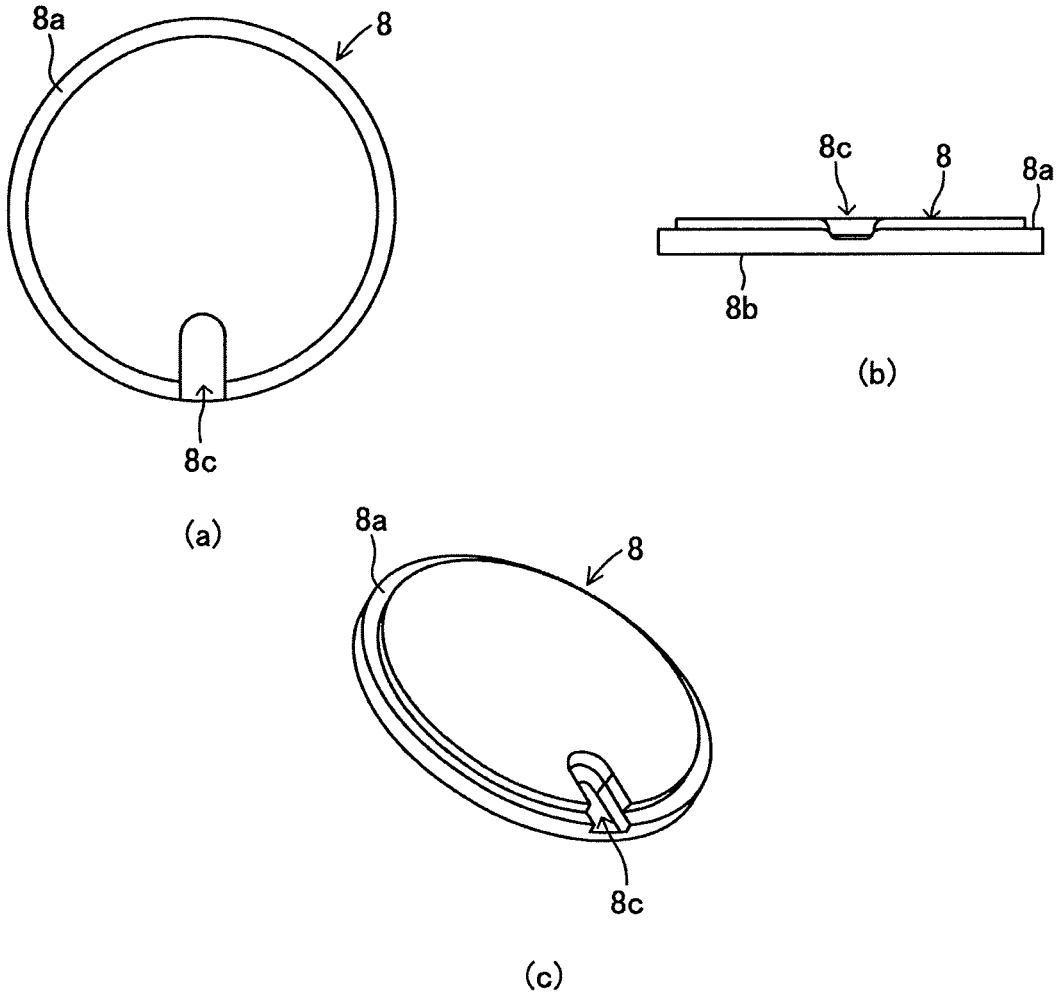
FIG. 4 is a schematic view for showing another configuration of an impregnation member used for an evaporation type burner according to Working Example 1 of the present invention, including (a) a front view observed from a downstream side, (b) a bottom view of (a), (c) a perspective view observed from the downstream side, and (d) a perspective view observed from an upstream side.

Moreover, a corner between the peripheral wall surface in a circumferential direction and the bottom wall surface on the upstream side, which form the concave part 8*c*, and a corner between the peripheral wall surface in the circumferential direction and the principal surface on the downstream side, which form the concave part 8*c*, may have a shape with sharp edge without being chamfered as shown in FIG. 3, or may have a chamfered shape such as a curved surface, etc. as shown in FIG. 4, for example.

In the present working example, the concave part 8*c* is formed toward a center of the impregnation member 8 from an outer end in the radial direction of the impregnation member 8, an outer end in the radial direction of the concave part 8*c* is located below a center of the impregnation member 8 and a center side end of the concave part 8*c* is formed so as to be located below a center in a vertical direction of the impregnation member 8. However, in an evaporation type burner according to the present invention, the concave part 8*c* is not an indispensable constituent feature and the concave part 8*c* does not need to be formed.

The impregnation member 8 may be constituted by one layer or a plurality of layers. In the latter case, for example, the impregnation member 8 may be constituted by a laminated body including a plurality of layers which consist of a member having a capillary structure and/or porous structure such that coarseness of a layer exposed to the first end side (upstream side) is finer than coarseness of a layer exposed to the second end side (downstream side), among the plurality of the layers which constitute the impregnation member 8. In the present working example, the impregnation member 8 is constituted by two layers, and a wick formed of finer fiber is adopted for the upstream side layer as compared with the downstream side layer and thereby permeability of fuel is raised, while a wick formed of rougher fiber is adopted for the downstream side layer as compared with the upstream side layer and thereby durability against flame is raised.

On a downstream side (second end side) from the impregnation member 8 in the combustion chamber 30, a promotion member 10 is disposed a predetermined distance apart from the impregnation member 8. The promotion member 10 is a member in which many through-holes are formed. The promotion member 10 in the present working example is formed as a plate in a shape of a perfect circle, and prepared so as to cover the whole cross-section of the combustion chamber 30 in a plane intersecting perpendicularly with an axis of the inner side housing 3. Moreover, between the impregnation member 8 and the promotion member 10, a space formation member 12 for forming a space 11 among them is disposed.

The space formation member 12 comprises a periphery part 12*a* which is engaged with the step part 8*a* of the impregnation member 8 except the concave part 8*c* and has a shape of a "C" character with a part corresponding to the concave part 8*c* cut out, and a plurality of leg parts 12*b* which are properly disposed a predetermined interval apart from each other in a circumferential direction of the periphery part 12*a* and project toward the downstream side from the periphery part 12*a*. By making downstream side ends of the plurality of these leg parts 12*b* contact with the promotion member 10, a predetermined spacing is secured between the impregnation member 8 and the promotion member 10, and the space 11 is formed between them.

As shown in FIG. 1 and FIG. 2, the promotion member 10 has many through-holes 10*a* formed at a predetermined interval all over its whole surface other than its lower part. Furthermore, a long through-hole 10*b* is formed in a part of the promotion member 10 located on a downstream side from the concave part 8*c* of the impregnation member 8.

The promotion member 10 is configured so as to be positioned by contacting with position parts 14 projected inside from the peripheral wall 3*a* of the inner side housing 3 when being inserted from the upstream side of the inner side housing 3. As a configuration of the position part 14, any structures and/or mechanisms can be employed. In the present working example, the position parts 14 are formed by making the peripheral wall 3*a* of the inner side housing 3 project inside. The position parts 14 may be formed integrally with the inner side housing 3, or may be formed as a part separate from the inner side housing 3.

Furthermore, a holding member 15 is fixed to the inner side housing 3 on the upstream side from the impregnation member 8 by a technique, such as welding. By sandwiching the impregnation member 8 between the holding member 15 and the space formation member 12 in this way, a breakage of the impregnation member 8 due to vibration generated when the evaporation type burner 1 is being used, etc. can be prevented. In the present working example, the holding member 15 functions also as a bottom wall of the inner side housing 3.

However, techniques for positioning the impregnation member 8 and the promotion member 10 in the combustion chamber 30 defined inside the inner side housing 3 are not limited to the above. For example, position parts may be formed in each of the impregnation member 8 and the promotion member 10, or may be fixed inside the peripheral wall 3*a* of the inner side housing 3 by a technique, such as welding.

A through-hole is formed in the holding member 15, and a fuel feeding pipe 16 is connected to this through-hole. Thereby, fuel is supplied to the principal surface 8*b* on the upstream side of the impregnation member 8, which is a smooth surface, from a fuel supply part which is not shown, through the fuel feeding pipe 16. A position of the through-hole (namely, position at which the fuel feeding pipe 16 is connected) in the holding member 15 is not particularly limited as long as it is possible to supply fuel to the smooth surface of the impregnation member 8. In the present working example, the fuel feeding pipe 16 is connected to a position of the holding member 15 corresponding to a central part of the principal surface 8*b* on the upstream side of the impregnation member 8.

An orifice 20 is internally fitted and fixed at an end on the downstream side of the inner side housing 3 to reduce cross sectional area of the combustion chamber 30 (namely, a channel of combustion gas is narrowed). Thereby, a part of the combustion gas which has arrived at the end on the downstream side of the combustion chamber 30 turns to the upstream side to promote mixing of gases in the combustion chamber 30, and this also leads to return unburnt fuel to the upstream side and burn the unburnt fuel. However, techniques for reducing the cross section area in the downstream part of the combustion chamber 30 are not limited to the above. For example, the orifice 20 may be formed by bending the peripheral wall 3*a* of the inner side housing 3 inside, rather than using an orifice as a separate part. Moreover, in an evaporation type burner according to the present invention, the orifice 20 is not an indispensable constituent element, and the orifice 20 does not need to be formed.

Furthermore, as shown in FIG. 2, an ignition device mounting member 21 is disposed at a position corresponding to the outside end in the radial direction of the concave part 8*c* in the outside housing 2. A leading end (end on a side of the combustion chamber 30) of the ignition device mounting member 21 is configured so as to reach an inside of the air-supply path 4, but not to contact the inner side housing 3. Thereby, heat in the combustion chamber 30 can be prevented from conducting to the outside housing 2 through the ignition device mounting member 21 at the time of combustion of fuel to have an influence due to heat to an installation other than the evaporation type burner 1, etc.

The ignition device 22 is fixed to the ignition device mounting member 21. The ignition device 22 is not particularly limited as long as it is possible to heat and ignite vapor of fuel evaporated from the impregnation member 8, and any spark plugs can be used. In the present working example, a glow plug is used as the ignition device 22.

Although an arrangement position of the ignition device 22 is not particularly limited as long as it is possible to heat and ignite vapor of fuel evaporated from the impregnation member 8, typically, the ignition device 22 is disposed so as to be exposed to an ignition space (including the space 11) which is a space located on the first end side (upstream side) from the promotion member 10 in the combustion chamber 30. In addition, a space located on the second end side (downstream side) from the promotion member 10 in the combustion chamber 30 is referred to as a "combustion space."

In the present working example, the ignition device 22 is disposed so as to project upward from the peripheral wall 3*a* of the inner side housing 3 below a center in the vertical direction of the impregnation member 8 in the ignition space. In addition, the leading end (exothermic part) of the ignition device 22 is disposed such that the leading end is located below the center in the vertical direction of the impregnation member 8, and such that at least a part of the leading end is located within the concave part 8*c*.

A first air supply opening 24 configured such that at least a part of the first air supply opening 24 opens into the ignition space and supplies air to the ignition space is formed in the peripheral wall 3*a* of the inner side housing 3. Namely, the first air supply opening 24 may be formed such that the whole opening opens into the ignition space, or it may be formed so as to open ranging over the ignition space and the combustion space, like a working example shown in FIG. 2.

In the present working example, a plurality of the first air supply openings 24, each of which consists of a small hole drilled in the peripheral wall 3*a* of the inner side housing 3, are formed at a predetermined interval over the whole circumferential direction. However, the first air supply opening 24 may be formed only in a lower part of the peripheral wall 3*a*, rather than being formed over the whole circumferential direction of the peripheral wall 3*a*.

Furthermore, in the present working example, auxiliary air supply openings 25, each of which consists of a small hole drilled in the peripheral wall 3*a* of the inner side housing 3, are formed in a downstream side vicinity of the promotion member 10 of the peripheral wall 3*a* of the inner side housing 3. However, in an evaporation type burner according to the present invention, the auxiliary air supply opening 25 is not an indispensable constituent element, and the auxiliary air supply opening 25 does not need to be formed.

In addition, a second air supply opening 28 which opens to the combustion space which is a space located on the second end side (downstream side) from the promotion member 10 in the combustion chamber 30 and supplies air to the combustion space is formed in the peripheral wall 3*a* of the inner side housing 3. In the present working example, a plurality of the second air supply openings 28, each of which consists of a small hole drilled in a region a predetermined distance apart from the promotion member 10 of the peripheral wall 3*a* of the inner side housing 3, are formed at a predetermined interval over the whole circumferential direction.

Configurations of the second air supply opening 28 (for example, shape, size and arrangement, etc. of each opening) will be explained in detail in other working examples which will be mentioned later.

Operation

Hereafter, an operation of the evaporation type burner 1 will be explained.

When fuel is supplied to the impregnation member 8 through the fuel feeding pipe 16 from a fuel supply unit, fuel permeates the impregnation member 8. In the present working example, since fuel is supplied to the principal surface 8*b* on the upstream side of the impregnation member 8 which is a smooth surface, it is easy for fuel permeates the impregnation member 8 uniformly and smoothly. After fuel thus permeates the impregnation member 8, fuel evaporates from the impregnation member 8. Air is supplied to the combustion chamber 30 through the air-supply pipe 5 and the air-supply path 4.

Next, electricity is turned on to the glow plug as the ignition device 22, and the leading end generates heat to sufficient temperature for ignition of vapor of fuel evaporated from the impregnation member 8. Since at least a part of the first air supply opening 24 opens to the ignition space which communicates with the space 11 between the impregnation member 8 and the promotion member 10, required amount of air for igniting the vapor of fuel evaporated from the impregnation member 8 is supplied to the ignition space. As a result, as compared with an evaporation type burner according to the previously mentioned conventional technology, fuel can be ignited earlier and more easily. Moreover, a lifetime of the impregnation member 8 can be prevented also from becoming shorter due to unstable combustion.

Fuel supplied from the fuel feeding pipe 16 has a strong tendency to permeate and spreads downward in the inside of the impregnation member 8 by action of gravity and, at least at a beginning of permeation, more fuel evaporates from a lower part of the impregnation member 8 than an upper part thereof. On the other hand, the ignition device 22 is disposed so as to project upward from the peripheral wall 3*a* of the inner side housing 3 below the center in the vertical direction of the impregnation member 8 in the ignition space, and the leading end (exothermic part) is disposed so as to be located below the center in the vertical direction of the impregnation member 8. Thereby, fuel can be ignited further earlier and more easily. Moreover, since flame generated due to ignition of fuel goes upward, the flame can be early grown up over the whole principal surface on the downstream side of the impregnation member 8, by thus igniting fuel at the lower part of the impregnation member 8.

Moreover, the ignition device 22 is disposed such that at least a part thereof is located in the inside of the concave part 8*c*. Thereby, since a distance between a surface of the impregnation member 8 where vapor of fuel is generated and a surface of the ignition device 22 can be reduced, ignitability can be improved, and it leads to downsize the ignition space and also to downsizing of the evaporation type burner 1.

Furthermore, since the promotion member 10 is disposed on the downstream side from the impregnation member 8, temperature fall of the ignition device 22 and/or extinction of flame, which has once been ignited, due to exhaust gas flowing therein from the aperture 2*a* on the downstream side and air flowing into the combustion space of the combustion chamber 30 from the second air supply opening 28, for example, can be prevented, and ignitability can be improved.

When flame thus grows, the impregnation member 8 is warmed and evaporation of fuel is promoted. The promotion member 10 is also heated by the flame, the impregnation member 8 is warmed by its radiant heat, and evaporation of fuel is further promoted.

When evaporation of fuel is thus promoted, the vapor of fuel comes to pass through the through-hole of the promotion member 10 to flow into the combustion space of the combustion chamber 30. On this occasion, mixture containing the vapor of fuel passes through the through-hole of the promotion member 10 and/or collides with a surface in which the through-hole is not formed, and thereby concentration of fuel in the mixture can be made uniform, and a combustion state can be made uniform.

When combustion progresses further, evaporation of fuel from the impregnation member 8 is promoted further, concentration of fuel in the ignition space is increased, and a "steady combustion", in which flame generates in the combustion space which is a space on the downstream side from the promotion member 10 in the combustion chamber 30, is attained. Namely, flame occurs in the ignition space on the upstream side from the promotion member 10 during an "ignition period" at a beginning of ignition, and flame occurs in the combustion space on the downstream side from the promotion member 10 during a subsequent "steady combustion period." Therefore, since it is suppressed that the impregnation member 8 is directly heated by flame during the steady combustion period, a lifetime of the impregnation member 8 can be prolonged.

Effects

As explained above, in accordance with the evaporation type burner 1, a suitable amount of air for ignition of fuel by the ignition device can be supplied to the vicinity of the ignition device through the first air supply opening. As a result, ignitability of the evaporation type burner can be improved, and a wick's lifetime can be prolonged. Namely, the above-mentioned first problem can be solved.

Furthermore, since fuel is supplied to the smooth surface formed in the surface on the first end side of an impregnation member, fuel can permeate the inside of the impregnation member easily and uniformly. In addition, since the ignition device is disposed such that at least a part of the ignition device is located in the inside of the concave part (or cutout) formed in the region of the impregnation member, which is opposite to the ignition device. Therefore, heat transfer from the ignition device to the impregnation member can be improved, and ignitability of the evaporation type burner can be further improved. Namely, the above-mentioned second problem can be solved.

Modification of Working Example 1

Modification 1 of Promotion Member

Figure 5:
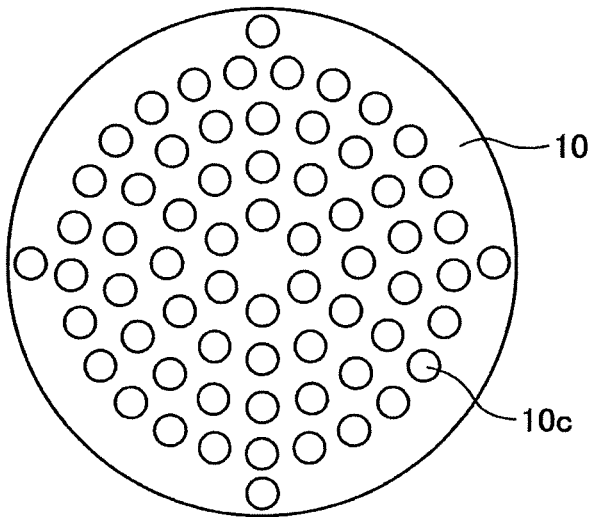
FIG. 5 is a schematic view for showing an example of a promotion member according to a modification of Working Example 1 of the present invention.
Figure 6:
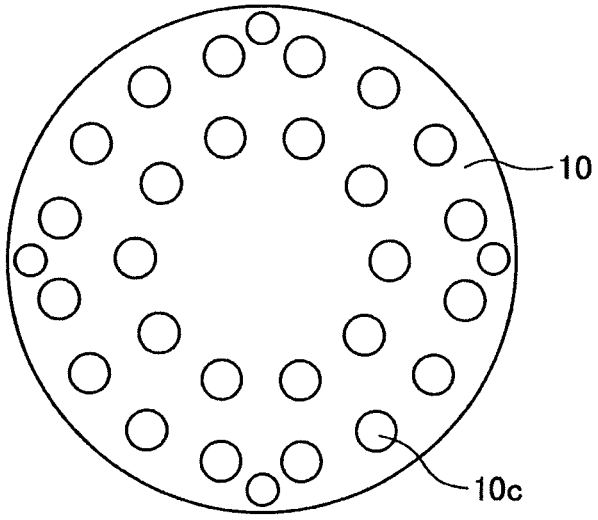
FIG. 6 is a schematic view for showing another example of a promotion member according to a modification of Working Example 1 of the present invention.

Configuration of the promotion member 10 is not limited to the configuration in which the through-holes 10*a* and the long hole 10*b* are formed as shown in FIG. 1 and FIG. 2. For example, through-holes 10*c* having the same shape (for example, a shape of a perfect circle) and size may be formed all over the promotion member 10 as shown in FIG. 5, or through-holes 10*c* having the same shape (for example, a shape of a perfect circle) and size may be formed all over a periphery part except a central part of the promotion member 10 as shown in FIG. 6.

Figure 7:
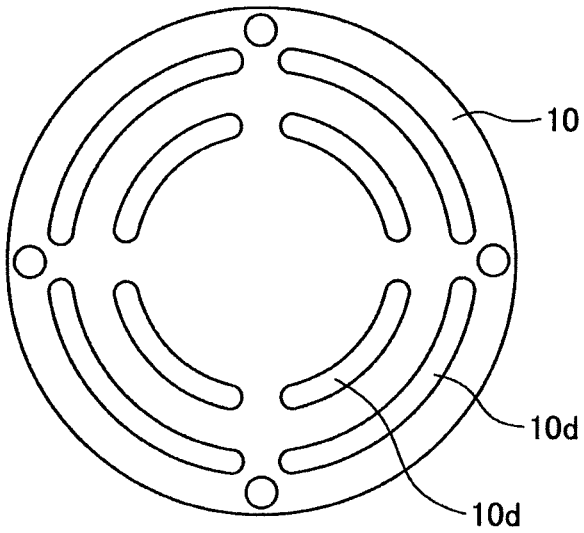
FIG. 7 is a schematic view for showing another example of a promotion member according to a modification of Working Example 1 of the present invention.
Figure 8:
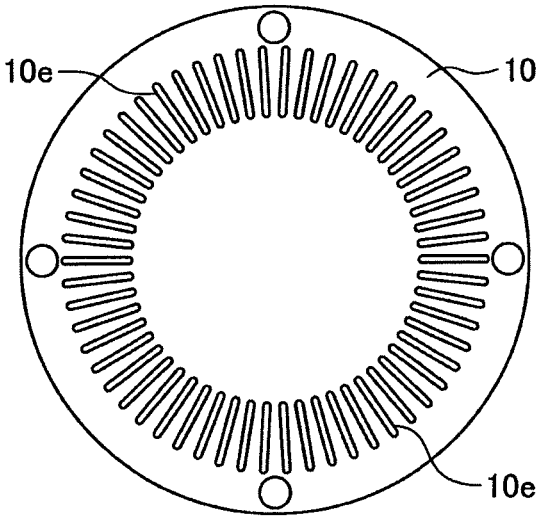
FIG. 8 is a schematic view for showing another example of a promotion member according to a modification of Working Example 1 of the present invention.

Moreover, as shown in FIG. 7, long holes 10*d* in a shape of a circular arc centering on a center of the promotion member 10 may be properly formed at a predetermined interval in a circumferential direction, and such long holes 10*d* in a shape of a circular arc may be formed at a plurality of columns in a radial direction (coaxially and in multiple manner). Furthermore, as shown in FIG. 8, many long holes 10*e* may be formed radially (namely, such that longitudinal directions of the long holes 10*e* pass through the center of the promotion member 10) at a properly predetermined interval in a circumferential direction all over a periphery part except a central part of the promotion member 10.

Figure 9:
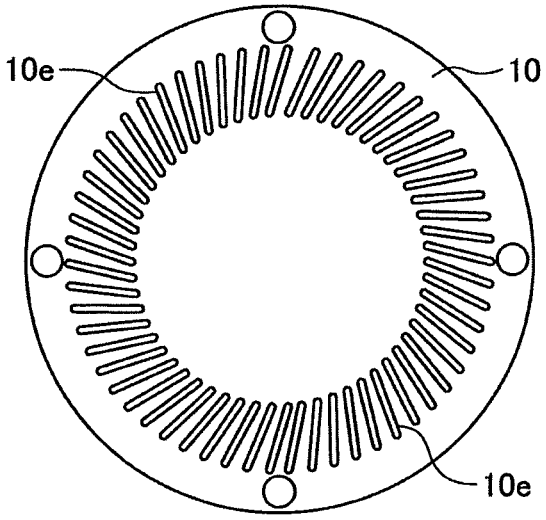
FIG. 9 is a schematic view for showing another example of a promotion member according to a modification of Working Example 1 of the present invention.
Figure 10:
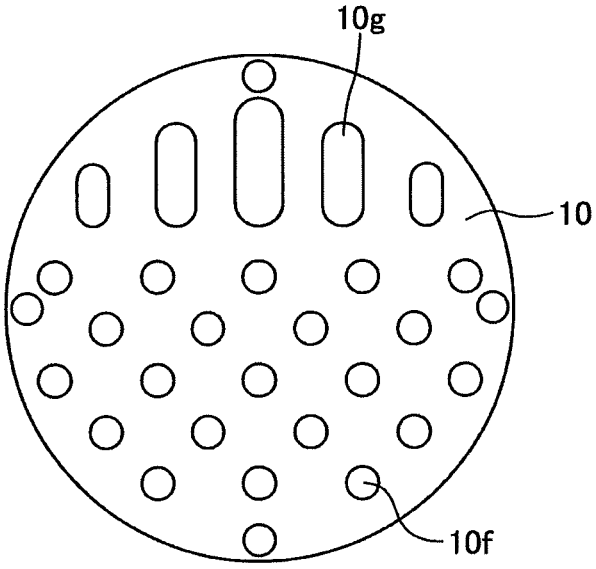
FIG. 10 is a schematic view for showing another example of a promotion member according to a modification of Working Example 1 of the present invention.

In addition, many long holes 10*e* inclined such that an angle between a longitudinal direction of the long hole 10*e* and a radial direction of the promotion member 10 is a predetermined angle may be formed at a properly predetermined interval in a circumferential direction all over a periphery part except a central part of the promotion member 10, as shown in FIG. 9. Moreover, combination of through-holes having different shapes and sizes may be formed. For example, as shown in FIG. 10, small holes 10*f* in a shape of a perfect circle may be formed in a central part and a lower part of the promotion member 10, and long holes 10*g* may be formed in an upper part of the promotion member 10 such that their longitudinal direction are in a vertical direction.

Modification 2 of Promotion Member

In the example shown in FIG. 2, as mentioned above, the promotion member 10 is formed as a plate, and the space formation member 12 is disposed between the impregnation member 8 and the promotion member 10 to form the space 11 between them. However, techniques for spacing between an impregnation member and a promotion member to form a space are not limited to the above, and a space may be formed by bending a part of a promotion member to make the part contact with an impregnation member.

Figure 11:
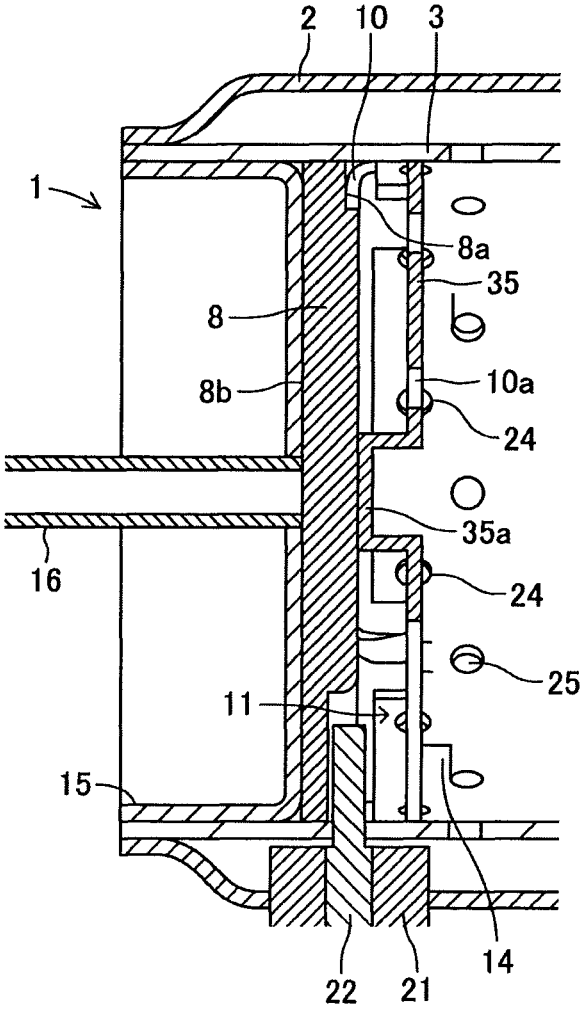
FIG. 11 is a schematic sectional view of a main part for showing an example of an evaporation type burner according to a modification of Working Example 1 of the present invention.
Figure 12:
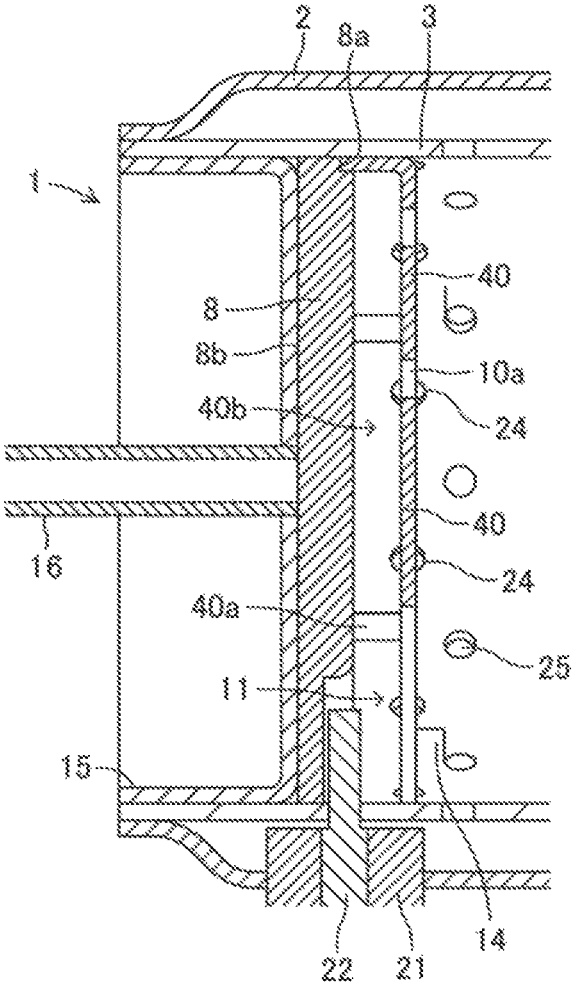
FIG. 12 is a schematic sectional view of a main part for showing another example of an evaporation type burner according to a modification of Working Example 1 of the present invention.

Specifically, as shown in FIG. 11, a central part of the promotion member 35 may be bended so as to be convex to the upstream side to form a contact part 35*a* and make the contact part 35*a* contact with the principal surface on the downstream side of the impregnation member 8, for example. Moreover, as shown in FIG. 12, a periphery part of the promotion member 40 may be bended to the upstream side to form a plurality of leg parts 40*a*, cutout parts 40*b* may be formed among the leg parts 40*a*, and the leg parts 40*a* may be made to contact with the principal surface on the downstream side of the impregnation member 8. Namely, the promotion member 10 and the space formation member 12 in the example shown in FIG. 2 may be integrally formed as the promotion member 40 having the leg parts 40*a* and the cutout parts 40*b*.

Furthermore, the space 11 may be divided into a plurality of partitions by the promotion members 10, 35 and 40, etc. In this case, however, it is necessary to configure such that at least a part of the first air supply opening opens at least to a partition including a space in which the ignition device 22 is exposed.

Effect in Modifications 1 and 2 of Promotion Member

In any of the various modifications of the promotion member, which have been explained above, the same effect as the above-mentioned Working Example 1 can be attained.

Moreover, when a space is formed between an impregnation member and a promotion member by making the promotion member contact with the impregnation member like the promotion members 35 and 40 according to Modification 2, heat conduction to the impregnation member from the promotion member heated by flame is promoted, and evaporation of fuel from the impregnation member can be further promoted. Furthermore, since the space formation member 12 can be omitted, this leads also to reduction of a manufacturing cost.

Modification 1 of Impregnation Member

Figure 13:
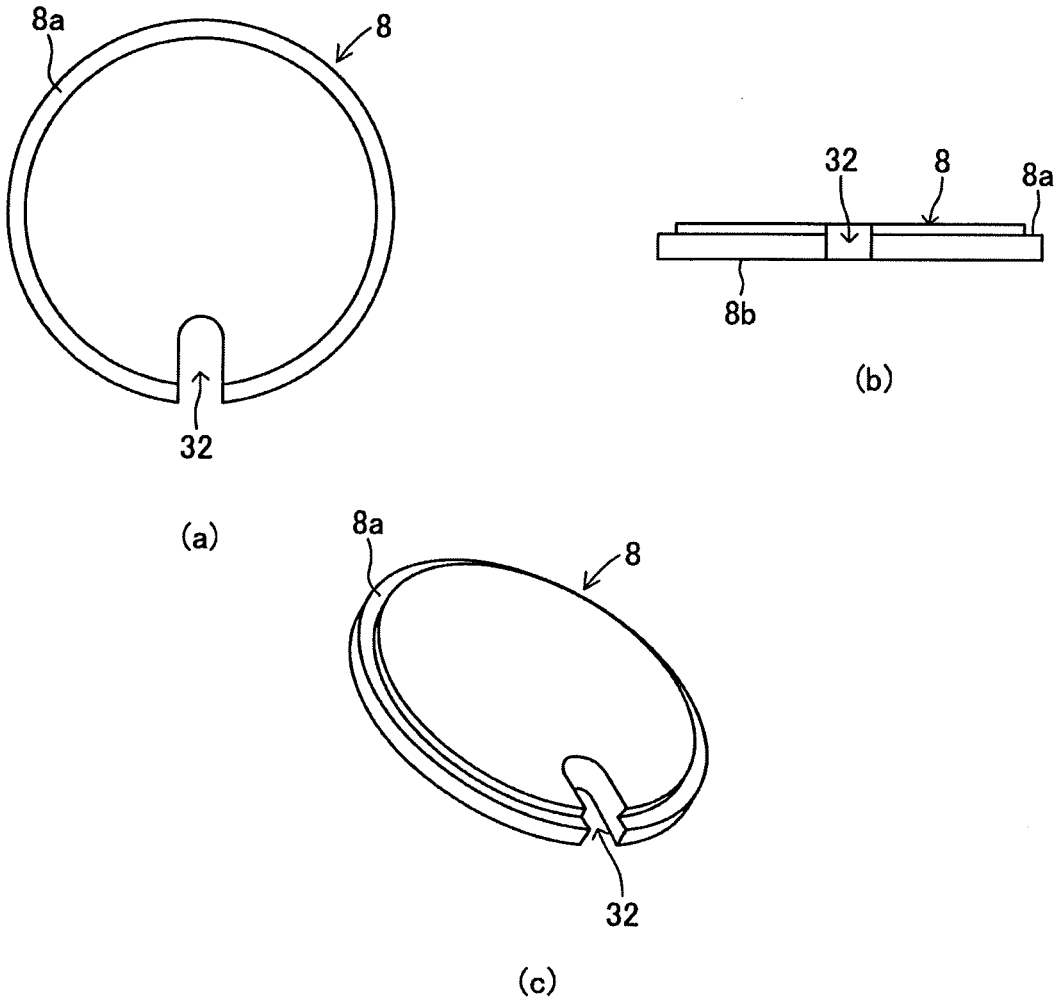
FIG. 13 is a schematic view for showing an example of an impregnation member according to a modification of Working Example 1 of the present invention, including (a) a front view observed from a downstream side, (b) a bottom view of (a), (c) a perspective view observed from the downstream side, and (d) a perspective view observed from an upstream side.

In Working Example 1, as shown in FIG. 3, the concave part 8*c* which opens toward the outside in the radial direction and the downstream side of the impregnation member 8 is formed. However, as mentioned above, the configuration of the concave part 8*c* is not particularly limited as long as at least a part of the ignition device 22 is housed therein. For example, as shown in FIG. 13, a cutout 32 which opens in three directions, i.e., toward the outside in the radial direction, the downstream side and the upstream side of the impregnation member 8, may be formed.

Modification 2 of Impregnation Member

Figure 14:
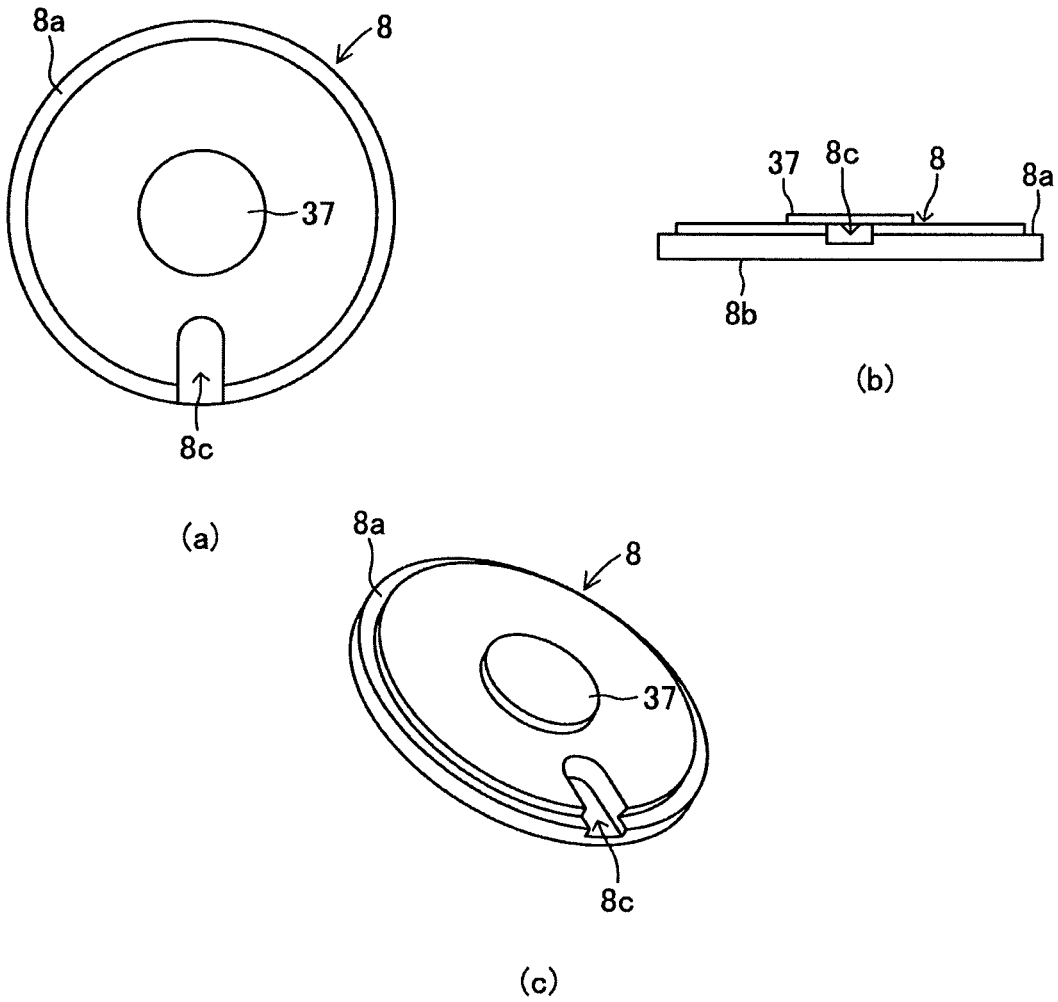
FIG. 14 is a schematic view for showing another example of an impregnation member according to a modification of Working Example 1 of the present invention, including (a) a front view observed from a downstream side, (b) a bottom view of (a), (c) a perspective view observed from the downstream side, and (d) a perspective view observed from an upstream side.
Figure 15:
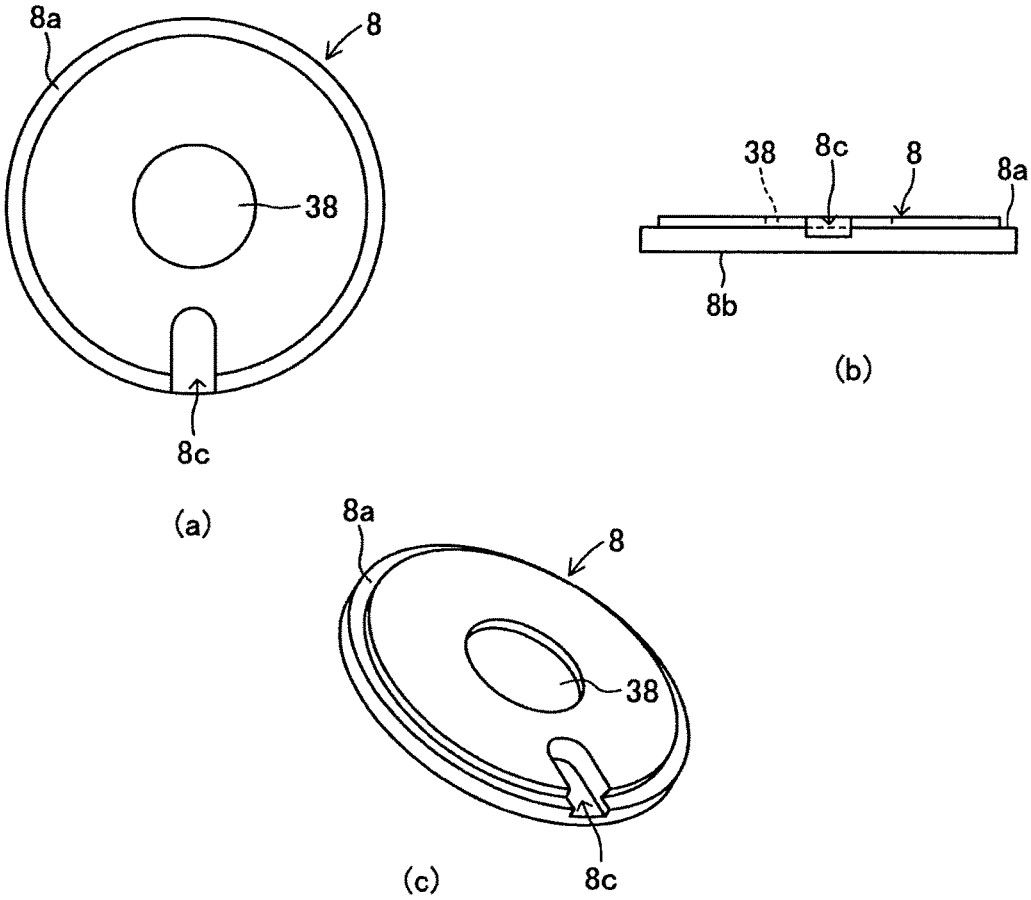
FIG. 15 is a schematic view for showing another example of an impregnation member according to a modification of Working Example 1 of the present invention, including (a) a front view observed from a downstream side, (b) a bottom view of (a), (c) a perspective view observed from the downstream side, and (d) a perspective view observed from an upstream side.

Although the principal surface on the downstream side of the impregnation member 8 other than the step part 8*a* and the concave part 8*c* or the cutout 32 is formed planar in Working Example 1 and the above-mentioned Modification 1, the principal surface on the downstream side of the impregnation member 8 does not necessarily need to be planar and, for example, unevenness etc. may be formed. For example, a convex part 37 which projects toward the downstream side may be prepared as shown in FIG. 14, or a concave part 38 which opens to the downstream side may be prepared as the shown in FIG. 15.

Moreover, also as for the principal surface 8*b* on the upstream side of the impregnation member 8, at least a part to which fuel is supplied should be constituted by a smooth surface, and unevenness etc. may be formed in other parts for the purpose of engagement with another member, etc., for example.

Modification 3 of Impregnation Member

In Working Example 1 and the above-mentioned Modifications 1 and 2, one concave part 8*c* or cutout 32 of the impregnation member 8 and one ignition device 22 are prepared. However, the numbers of them may be two or more as long as the ignition device is disposed so as to project upward from the peripheral wall of the inner side housing below the center in the vertical direction of the impregnation member in the ignition space, a leading end of the ignition device is disposed so as to be located below the center in the vertical direction of the impregnation member, and at least a part of the ignition device is house within the concave part or cutout, in a state where the evaporation type burner according to the present invention is being used.

Figure 16:
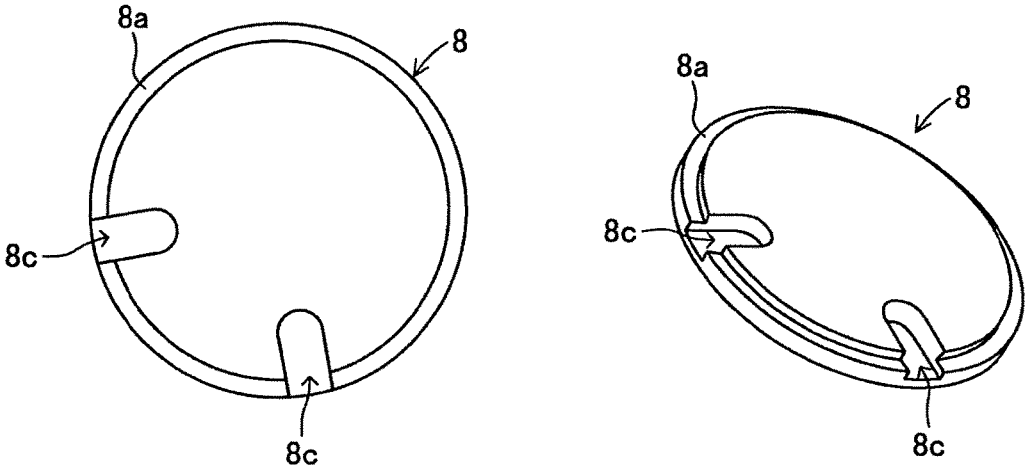
FIG. 16 is a schematic view for showing another example of an impregnation member according to a modification of Working Example 1 of the present invention, including (a) a front view observed from a downstream side, (b) a bottom view of (a), (c) a perspective view observed from the downstream side, and (d) a perspective view observed from an upstream side.

For example, as shown in FIG. 16, two concave parts 8*c* may be respectively prepared in a lower end part and side part of the impregnation member 8, and it may be configured such that the leading ends of the ignition devices 22 are respectively located at least partially in the inside of these two concave parts 8*c* (namely, one ignition device 22 is prepared for each concave part 8*c*).

Effect in Modifications 1 to 3 of Impregnation Member

In any of the various modifications of the impregnation member, which have been explained above, the same effect as the above-mentioned Working Example 1 can be attained.

Working Example 2

As explained above, in accordance with the evaporation type burner 1 according to Working Example 1 of the present invention, the first problem that ignitability of the evaporation type burner should be improved and a wick's lifetime should be prolonged by supplying a suitable amount of air for ignition of fuel by the ignition device to the vicinity of the ignition device and the second problem that ignitability of the evaporation type burner should be improved by improving heat transfer from an ignition mechanism to a wick while avoiding that permeation of fuel into the wick becomes difficult can be simultaneously solved.

An evaporation type burner according to Working Example 2 of the present invention, which will be explained below, is intended to solve the third problem that shortage of air which leads to incomplete combustion of fuel on the downstream side of the combustion chamber should be reduced.

Configuration and Operation

The evaporation type burner according to Working Example 2 is characterized by being configured such that a flow rate of the air supplied to the combustion space of the combustion chamber 30 through the second air supply opening 28 on the second end side (downstream side) is larger than that on the first end side (upstream side) of the second air supply opening 28. Since the evaporation type burner according to Working Example 2 is the same as the above-mentioned evaporation type burner 1 except for this point, the evaporation type burner according to Working Example 2 will be explained paying attention to this point in the following explanations. Moreover, since the feature of the evaporation type burner according to Working Example 2 is drawn also in FIG. 2 which has been referred to in the explanation about the above-mentioned evaporation type burner 1, FIG. 2 will be referred to in the following explanations when needed.

In the evaporation type burner according to Working Example 2, the second air supply opening 28 is constituted by either or both of an air-supply aperture array, which is at least one array of a plurality of apertures, and an air-supply slit, which is at least one slit. The air-supply aperture array is at least one array of a plurality of apertures formed a predetermined distance apart from each other toward the downstream side from the upstream side in a predetermined region of the peripheral wall 3*a* of the inner side housing 3 which defines the combustion space of the combustion chamber 30. The air-supply slit is at least one slit formed so as to have a predetermined width and a predetermined length and extend toward the downstream side from the upstream side in a predetermined region of the peripheral wall 3*a* of the inner side housing 3 which defines the combustion space of the combustion chamber 30.

Figure 17:
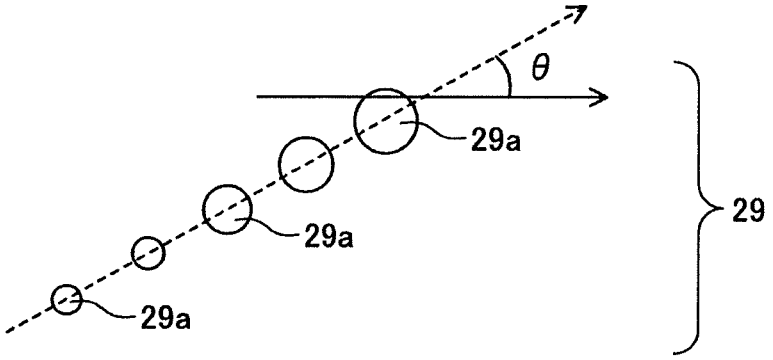
FIG. 17 is a schematic view for showing an example of an air-supply aperture array constituted as a second air supply opening formed in a peripheral wall of an inner side housing of an evaporation type burner according to Working Example 2 of the present invention.

In the evaporation type burner according to Working Example 2, as shown in FIG. 2, the second air supply opening 28 is constituted by an air-supply aperture array 29 which is a plurality of arrays of a plurality of apertures 29*a*. More particularly, as shown in FIG. 17, a plurality of the apertures 29*a* which constitute each air-supply aperture array 29 are configured such that an opening area of each aperture becomes gradually larger toward the downstream side from the upstream side. Thereby, it can be configured such that a flow rate of the air supplied to the combustion space of the combustion chamber 30 through the second air supply opening 28 on the downstream side is larger than that on the upstream side. FIG. 17 is a schematic view (two-dimensional view) for showing the air-supply aperture array 29 configured as the second air supply opening 28 formed in the peripheral wall 3*a* of the inner side housing 3 of the evaporation type burner according to Working Example 2 in a state where the peripheral wall 3*a* is developed into a planar shape.

Furthermore, in the evaporation type burner according to Working Example 2, as shown in FIG. 17, the air-supply aperture array 29 is configured such that an angle between a longitudinal direction (broken line arrow) of the air-supply aperture array 29 and a direction (solid line arrow) parallel to an axis of the inner side housing 3 is a predetermined angle (θ). Namely, a plurality of the apertures 29*a* which constitute each air-supply aperture array 29 are arranged in a spiral form centering on a central axis of the inner side housing 3. Thereby, a swirling flow can be produced in the combustion chamber 30, and continuity and uniformity of combustion in the combustion chamber 30 can be improved.

In addition, as shown in FIG. 2, the evaporation type burner according to Working Example 2 further comprises an outside housing 2 disposed on an outer periphery of the inner side housing 3, and an air-supply pipe 5 which supplies air into the outside housing 2 through a third air supply opening which is an aperture formed in a peripheral wall of the outside housing 2. An air-supply path 4 which is a space whose both ends on its upstream side and downstream side are closed is formed between the peripheral wall of the outside housing 2 and the peripheral wall 3*a* of the inner side housing 3, and the third air supply opening is formed on a downstream side from the second air supply opening 28. More specifically, the third air supply opening is formed on a further downstream side from an aperture 29*a* located on the most downstream side among a plurality of the apertures 29*a* which constitute the air-supply aperture array 29. Thereby, it can be configured such that a flow rate of the air supplied to the combustion space of the combustion chamber 30 through the second air supply opening 28 on the downstream side is much larger than that on the upstream side.

Effects

As explained above, in accordance with the evaporation type burner according to Working Example 2, it can be configured such that a flow rate of the air supplied to the combustion space of the combustion chamber 30 through the second air supply opening 28 on the downstream side is larger than that on the upstream side. As a result, shortage of air which leads to incomplete combustion of fuel on the downstream side of the combustion chamber 30 can be reduced. Namely, the above-mentioned third problem can be solved.

Furthermore, in the evaporation type burner according to Working Example 2, since a plurality of the apertures 29*a* which constitute each air-supply aperture array 29 are arranged in a spiral form centering on the central axis of the inner side housing 3, a swirling flow can be produced in the combustion chamber 30, and continuity and uniformity of combustion in the combustion chamber 30 can be improved.

Modification of Working Example 2

Modification 1 of Second Air Supply Opening

Figure 20:
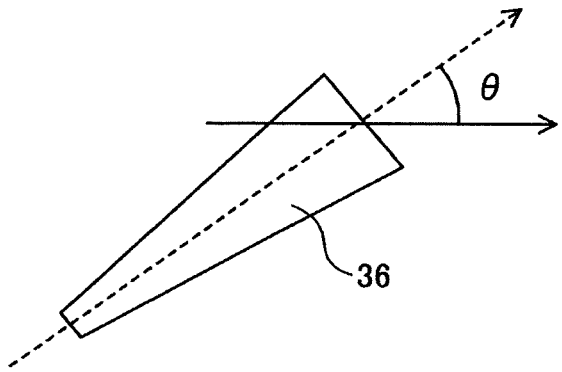
FIG. 20 is a schematic view for showing an example of an air-supply slit constituted as a second air supply opening formed in a peripheral wall of an inner side housing of an evaporation type burner according to a modification of Working Example 2 of the present invention.

As mentioned above, in the evaporation type burner according to Working Example 2, the second air supply opening 28 is constituted by either or both of an air-supply aperture array, which is at least one array of a plurality of apertures, and an air-supply slit, which is at least one slit. When the second air supply opening 28 is constituted by at least one air-supply slit, what is necessary is just to configure such that the width of an air-supply slit 36 becomes gradually larger toward the downstream side from the upstream side as shown in FIG. 20. Thereby, it can be configured such that a flow rate of the air supplied to the combustion space of the combustion chamber 30 through the second air supply opening 28 on the downstream side is larger than that on the upstream side. FIG. 20 is a schematic view (two-dimensional view) for showing the air-supply slit 36 configured as the second air supply opening 28 formed in the peripheral wall 3*a* of the inner side housing 3 of the evaporation type burner according to Working Example 2 in a state where the peripheral wall 3*a* is developed into a planar shape.

Furthermore, in the evaporation type burner according to Working Example 2, as shown in FIG. 20, the air-supply slit 36 is configured such that an angle between a longitudinal direction (broken line arrow) of the air-supply slit 36 and a direction (solid line arrow) parallel to an axis of the inner side housing 3 is a predetermined angle (θ). Namely, the air-supply slit 36 which constitutes the second air supply opening 28 is arranged in a spiral form centering on a central axis of the inner side housing 3. Thereby, a swirling flow can be produced in the combustion chamber 30, and continuity and uniformity of combustion in the combustion chamber 30 can be improved.

In addition, the second air supply opening 28 may be constituted by a combination of the air-supply aperture array 29 and the air-supply slit 36.

Modification 2 of Second Air Supply Opening

As mentioned above, by configuring the second air supply opening 28 such that an angle between a longitudinal direction of the air-supply aperture array 29 and/or the air-supply slit 36 and a direction parallel to an axis of the inner side housing 3 is a predetermined angle, a swirling flow can be produced in the combustion chamber 30, and continuity and uniformity of combustion in the combustion chamber 30 can be improved. In this case, the magnitude of the phase (deduction) in the spiral architecture of the second air supply opening 28 centering on the central axis of the inner side housing 3 may be changed within the combustion chamber 30.

Figure 18:
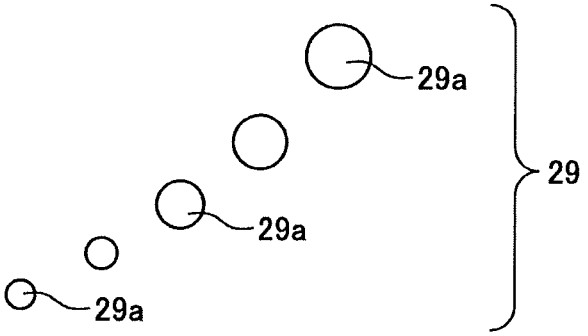
FIG. 18 is a schematic view for showing an example of an air-supply aperture array constituted as a second air supply opening formed in a peripheral wall of an inner side housing of an evaporation type burner according to a modification of Working Example 2 of the present invention.
Figure 19:
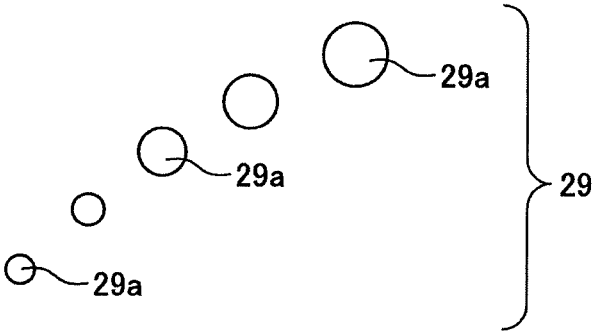
FIG. 19 is a schematic view for showing another example of an air-supply aperture array constituted as a second air supply opening formed in a peripheral wall of an inner side housing of an evaporation type burner according to a modification of Working Example 2 of the present invention.

When the second air supply opening 28 is constituted by the air-supply aperture array 29, the air-supply aperture array 29 may be configured such that the angle (θ) between a longitudinal direction of the air-supply aperture array 29 and a direction parallel to an axis of the inner side housing 3 changes toward the downstream side from the upstream side. Specifically, for example, it may be configured such that the above-mentioned angle (θ) becomes gradually larger toward the downstream side from the upstream side as shown in FIG. 18, or conversely it may be configured such that the above-mentioned angle (θ) becomes gradually smaller toward the downstream side from the upstream side as shown in FIG. 19. FIG. 18 and FIG. 19 are schematic views (two-dimensional views) for showing the air-supply aperture array 29 configured as the second air supply opening 28 formed in the peripheral wall 3*a* of the inner side housing 3 of the evaporation type burner according to Working Example 2 according to the present modification in a state where the peripheral wall 3*a* is developed into a planar shape.

Figure 21:
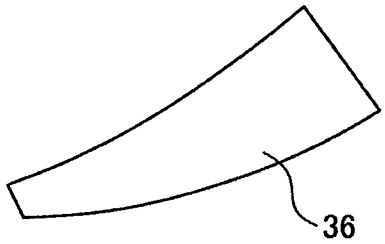
FIG. 21 is a schematic view for showing another example of an air-supply slit constituted as a second air supply opening formed in a peripheral wall of an inner side housing of an evaporation type burner according to a modification of Working Example 2 of the present invention.
Figure 22:
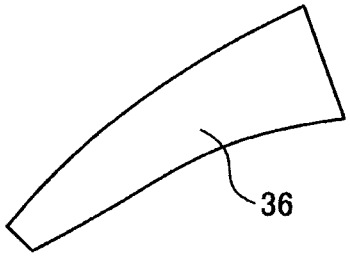
FIG. 22 is a schematic view for showing another example of an air-supply slit constituted as a second air supply opening formed in a peripheral wall of an inner side housing of an evaporation type burner according to a modification of Working Example 2 of the present invention.

On the other hand, when the second air supply opening 28 is constituted by the air-supply slit 36, the air-supply slit 36 may be configured such that the angle (θ) between a longitudinal direction of the air-supply slit 36 and a direction parallel to an axis of the inner side housing 3 changes toward the downstream side from the upstream side. Specifically, for example, it may be configured such that the above-mentioned angle (θ) becomes gradually larger toward the downstream side from the upstream side as shown in FIG. 21, or conversely it may be configured such that the above-mentioned angle (θ) becomes gradually smaller toward the downstream side from the upstream side as shown in FIG. 22. FIG. 21 and FIG. 22 are schematic views (two-dimensional views) for showing the air-supply slit 36 configured as the second air supply opening 28 formed in the peripheral wall 3*a* of the inner side housing 3 of the evaporation type burner according to Working Example 2 according to the present modification in a state where the peripheral wall 3*a* is developed into a planar shape.

In accordance with the above, strength of the above-mentioned swirling flow and/or distribution of the strength of the swirling flow in the combustion chamber 30, etc. can be controlled, for example.

Working Example 3

In the evaporation type burners 1 and according to Working Example 2 which have been explained above, a promotion member which has a planar shape (shape of a plate) as a whole except for a partial bend part is used. However, in a promotion member in a shape of a plate, deformation (thermal deformation) of the promotion member resulting from temperature change accompanying combustion of fuel may occur. Therefore, in Working Example 3 of the present invention, stiffness (section modulus) of a promotion member is raised, and thermal deformation of the promotion member accompanying combustion of fuel is reduced.

Configuration

Figure 23:
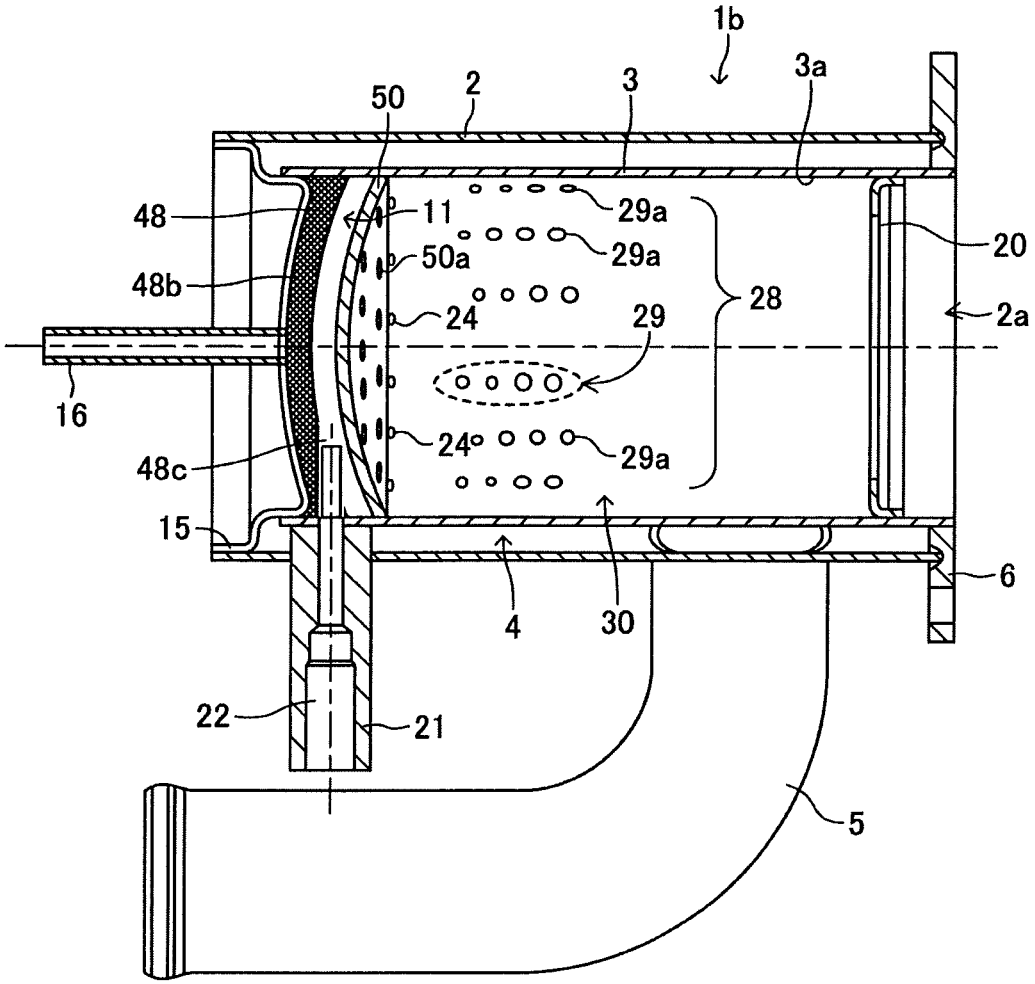
FIG. 23 is a schematic sectional view of an evaporation type burner according to Working Example 3 of the present invention.

As shown in FIG. 23, in an evaporation type burner 1*b* according to Working Example 3 of the present invention, a promotion member 50 is constituted by a member in a shape of a plate, which has a curved surface shape whose central part is convex to the upstream side. Furthermore, an impregnation member 48 is also constituted by a member in a shape of a plate, which has a curved surface shape whose central part is convex to the upstream side. Since the evaporation type burner 1*b* has the same configuration as the above-mentioned evaporation type burner 1 and operates similarly thereto except for these points, the evaporation type burner 1*b* will be explained paying attention to these points in the following explanations.

Effects

In accordance with the evaporation type burner 1*b*, since the promotion member 50 is constituted by a member in a shape of a plate, which has a curved surface shape whose central part is convex to the upstream side (first end side), as compared with a planar promotion member (in a shape of a plate), stiffness (section modulus) of the promotion member 50 increases, and deformation (thermal deformation) of the promotion member 50 resulting from temperature change accompanying combustion of fuel can be reduced. Moreover, when thermal deformation of a promotion member occurs, a degree of thermal deformation is large and it is difficult to determine a region and/or direction in which thermal deformation occurs in a planar promotion member, whereas a degree of thermal deformation is small and it is easy to determine a region and/or direction in which thermal deformation occurs in the promotion member 50 which has a curved surface shape.

On the other hand, the impregnation member 48 is also constituted by a member in a shape of a plate, which has a curved surface shape whose central part is convex to the upstream side (first end side). Therefore, increase in distance between the promotion member 50 and the impregnation member 48 accompanying with the promotion member 50 being constituted by the member in the shape of a plate, which has a curved surface shape, as mentioned above, can be reduced, and decrease in heat transfer from the promotion member 50 to the impregnation member 48 at the time of combustion of fuel can be reduced. As a result, decrease in generation of vapor of fuel from the impregnation member 48 at the time of combustion of fuel can be reduced (suppressed).

Figure 24:
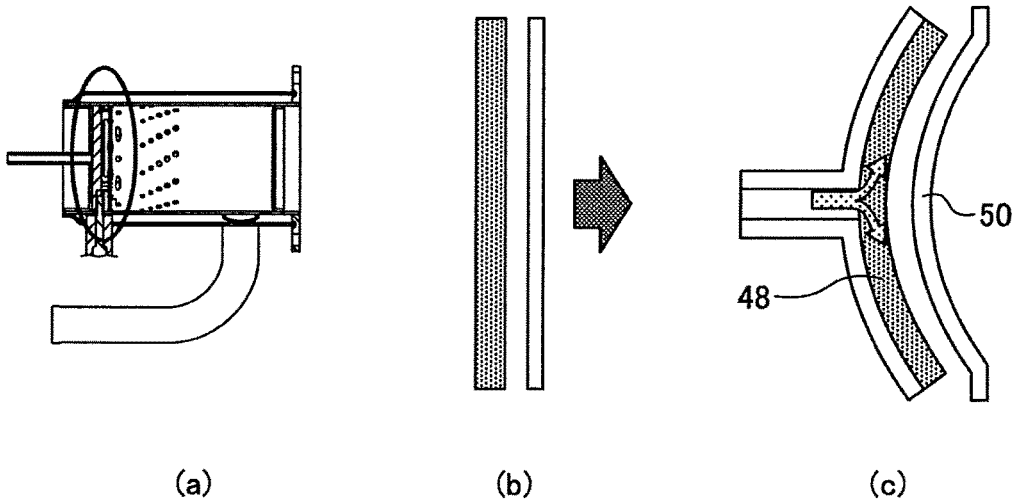
FIG. 24 is a schematic view for explaining that fuel supplied from a fuel feeding pipe smoothly permeates and easily spreads inside thereof in an impregnation member according to Working Example 3 of the present invention.

Furthermore, in the impregnation member 48 which has a curved surface shape shown in (c) of FIG. 24, as compared with a planar impregnation members as shown in (a) and (b) of FIG. 24, the fuel supplied from the fuel feeding pipe 16 can permeate smoothly along the curved surface of the impregnation member 48 to spread easily inside the impregnation member 48.

Figure 25:
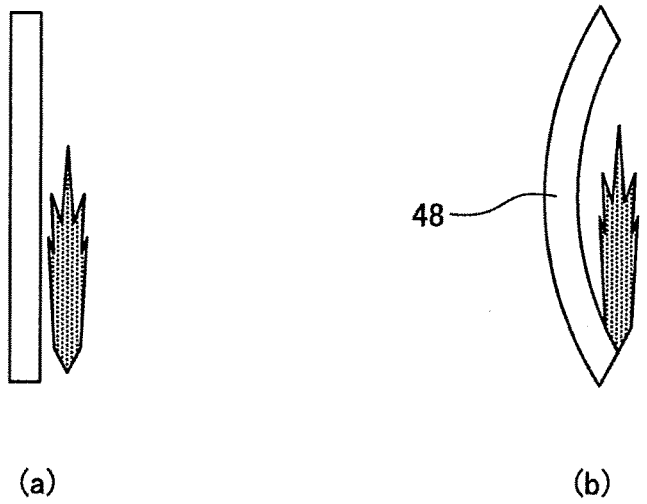
FIG. 25 is a schematic view for explaining that flame generated by ignition of fuel grows easily in an impregnation member according to Working Example 3 of the present invention.

In addition, as shown in FIG. 25, it is difficult for flame to grow up since no impregnation member exists above flame even when flame occurs by ignition of fuel in a planar impregnation member (a), whereas it is easy for flame to grow up since an impregnation member exists above flame in an impregnation member 48 (b) which has a curved surface shape.

Working Example 4

Configuration

When a promotion member is made to contact with an impregnation member to form a space between the impregnation member and the promotion member like the promotion members 35 and 40 according to the above-mentioned Modification 2 of Working Example 1 of the present invention, heat conduction to the impregnation member from the promotion member heated by flame is promoted, and evaporation of fuel from the impregnation member can be further promoted.

Figure 26:
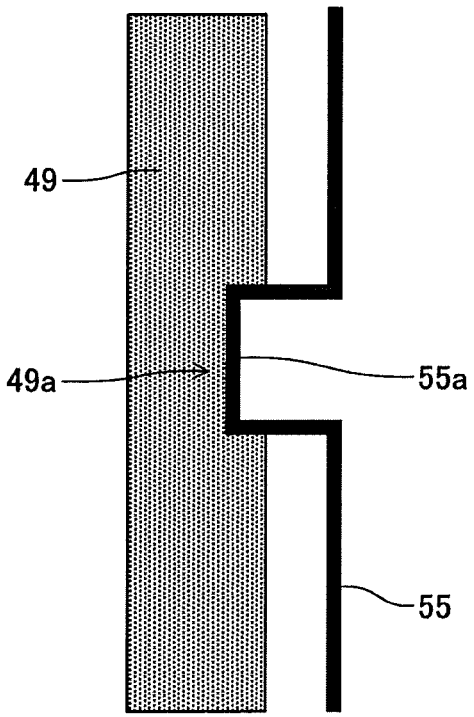
FIG. 26 is a schematic view for showing an example of configurations of a promotion member and impregnation member according to Working Example 4 of the present invention.

Then, in an evaporation type burner according to Working Example 4 of the present invention, as shown in FIG. 26, a promotion member 55 comprises a projection part 55*a* which is a part extending toward the upstream side, and the projection part 55*a* contacts with an impregnation member 49. More particularly, in the evaporation type burner according to Working Example 4, the projection part 55*a* is a bulge formed so as to be convex toward the upstream side in a part of the promotion member 55, and this bulge touches the impregnation member 49 by being fitted in a concave part 49*a* formed on the downstream side of the impregnation member 49.

Effects

In accordance with the evaporation type burner according to Working Example 4, heat conduction to the impregnation member 49 from the promotion member 55 heated by flame at the time of combustion of fuel is promoted, and evaporation of fuel from the impregnation member 49 can be further promoted. Furthermore, since the above-mentioned space formation member 12 can be omitted, it leads also to reduction of a manufacturing cost of the evaporation type burner according to Working Example 4.

Working Example 5

Configuration

Figure 27:
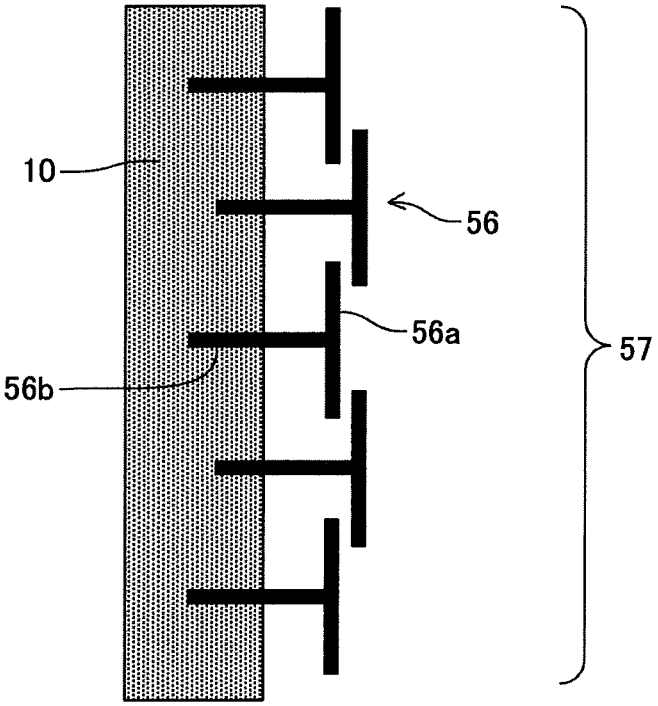
FIG. 27 is a schematic view for showing an example of configurations of a promotion member and impregnation member according to Working Example 5 of the present invention.

As shown in FIG. 27, in an evaporation type burner the according to Working Example 5 of the present invention, a promotion member 57 is constituted by promotion elements 56 which are a plurality of constituent elements. Each of the promotion elements 56 comprises a primary part 56*a* which is a part having a shape of a plate and a support part 56*b* which is a part having a shape of a pillar or column extending in a normal direction of the primary part 56*a*. Furthermore, each of the promotion elements 56 is independently fixed at a predetermined position by having the support part 56*b* inserted into the impregnation member 10, respectively. In addition, through-holes are formed of gaps between the primary parts 56*a*, which the plurality of the promotion elements 56 comprise, in promotion member 57.

Effects

In the evaporation type burner according to Working Example 5, the promotion member 57 is constituted by a plurality of the promotion elements 56 independently fixed at a predetermined position by each of their support parts 56*b* being inserted into the impregnation member 10. Since thermal deformation of each promotion member 56 is small, thermal deformation as the whole promotion member 57 accompanying combustion of fuel can be reduced.

Furthermore, since each support part 56*b* is inserted in the impregnation member 10, the heat conduction to the impregnation member 10 from (the promotion elements 56 of) the promotion member 57 heated by flame at the time of combustion of fuel is promoted, and evaporation of fuel from the impregnation member 10 can be promoted. In addition, since the above-mentioned space formation member 12 can be omitted, it leads also to reduction of a manufacturing cost of the evaporation type burner according to Working Example 5.

Although some embodiments and modifications having a specific configuration have been explained sometimes referring to accompanying drawings as mentioned above for the purpose of explaining the present invention, it should not be interpreted as the scope of the present invention being limited to these exemplary embodiments and modifications, and it is needless to say that corrections can be properly added within the limits of the matters described in the claims and the specification.

REFERENCE SIGNS LIST

1 and 1*b*: Evaporation type burner, 2: Outside housing, 2*a*: Aperture, 3: Inner side housing, 3*a*: Peripheral wall of an inner side housing, 4: Air-supply path, 5: Air-supply pipe, 6: Mounting member, 8: Impregnation member, 8*a*: Step part, 8*b*: Upstream side principal surface, 8*c*: Concave part, 10: Promotion member, 10*a* and 10*c*: Through-hole, 10*b*, 10*d*, 10*e* and 10*g*: Long hole, 10*f*: Small hole, 11: Space, 12: Space formation member, 12*a*: Periphery part, 12*b*: Leg part, 14: Position part, 15: Upstream side holding member (bottom wall of an inner side housing), 16: Fuel feeding pipe, 20: Orifice, 21: Ignition device mounting member, 22: Ignition device, 24: First air supply opening, 25: Auxiliary air supply opening, 28: Second air supply opening, 29: Air-supply aperture array, 29*a*: Aperture, 30: Combustion chamber, 32: Cutout, 35: Promotion member, 35*a*: Contact part, 36: Air-supply slit, 37: Convex part, 38: Concave part, 40: Promotion member, 40*a*: Leg part, 40*b*: Cutout, 48: Impregnation member, 48*b*: Upstream side principal surface, 48*c*: Concave part, 49: Impregnation member, 49*a*: Concave part, 50: Promotion member, 50*a*: Through-hole, 55: Promotion member, 55*a*: Projection part, 56: Promotion member, 56*a*: Primary part, 56*b*: Support part, and 57: Promotion member.

The invention claimed is:

1. An evaporation type burner comprising;

a combustion chamber which is a space defined by an inner side housing that is a bottomed cylindrical container consisting of a bottom wall and a peripheral wall, an impregnation member which is a member disposed at a first end that is an end on said bottom wall side of said inner side housing in said combustion chamber and having a capillary structure and/or porous structure, a fuel supply unit configured to supply fuel to said impregnation member and impregnate said impregnation member with said fuel, and an ignition device configured to heat and ignite vapor of said fuel evaporated from said impregnation member, wherein:

said evaporation type burner further comprises a promotion member which is a member having many through-holes formed therein and being disposed a predetermined distance apart from said impregnation member on a second end side from said impregnation member in said combustion chamber, and said second end is an end opposed to said first end of said combustion chamber, said ignition device is disposed so as to be exposed to an ignition space which is a space located on the first end side from said promotion member in said combustion chamber, a first air supply opening configured such that at least a part of said first air supply opening opens into said ignition space and supplies air to said ignition space and a second air supply opening configured so as to open into a combustion space and supply air to said combustion space are formed in said peripheral wall of said inner side housing, and said combustion space is a space located on said second end side from said promotion member in said combustion chamber, said second air supply opening is constituted by either one or both of an air-supply aperture array formed in said peripheral wall and an air-supply slit formed in said peripheral wall, said air-supply aperture array is at least one array of a plurality of apertures formed a predetermined distance apart from each other toward said second end side from said first end side in a predetermined region of said peripheral wall of said inner side housing which defines said combustion space, and said air-supply slit is at least one slit formed so as to have a predetermined width and a predetermined length and extend toward said second end side from said first end side in a predetermined region of said peripheral wall of said inner side housing which defines said combustion space, and said evaporation type burner is configured such that a flow rate of air supplied to said combustion space through said second air supply opening on said second end side of said second air supply opening is larger than that on said first end side of said second air supply opening.

2. The evaporation type burner according to claim 1, wherein:

said ignition device is disposed so as to project upward from said peripheral wall of said inner side housing below a center in a vertical direction of said impregnation member in said ignition space in a state where said evaporation type burner is being used.

3. The evaporation type burner according to claim 2, wherein:

a leading end of said ignition device is disposed so as to be located below the center in the vertical direction of said impregnation member in a state where said evaporation type burner is being used.

4. The evaporation type burner according to claim 1, wherein:

said fuel supply unit is configured so as to supply said fuel to a smooth surface formed on a surface on the first end side of said impregnation member, a concave part or cutout is formed in a region opposite to said ignition device of said impregnation member, and said ignition device is disposed such that at least a part of said ignition device is located within said concave part or said cutout.

5. The evaporation type burner according to claim 1, wherein:

a plurality of said apertures constituting said air-supply aperture array is configured such that an opening area of each aperture becomes gradually larger toward said second end side from said first end side, and the width of said air-supply slit is configured so as to become gradually larger toward said second end side from said first end side.

6. The evaporation type burner according to claim 1, wherein:

said air-supply aperture array is configured such that an angle between a longitudinal direction of said air-supply aperture array and a direction parallel to an axis of said inner side housing is a predetermined angle, and said air-supply slit is configured such that an angle between a longitudinal direction of said air-supply slit and a direction parallel to the axis of said inner side housing is a predetermined angle.

7. The evaporation type burner according to claim 6, wherein:

said air-supply aperture array is configured such that an angle between a longitudinal direction of said air-supply aperture array and a direction parallel to the axis of said inner side housing changes toward said second end side from said first end side, and said air-supply slit is configured such that an angle between a longitudinal direction of said air-supply slit and a direction parallel to the axis of said inner side housing changes toward said second end side from said first end side.

8. The evaporation type burner according to claim 1, further comprising:

an outside housing disposed on an outer periphery of said inner side housing, and an air-supply pipe which supplies air into said outside housing through a third air supply opening which is an aperture formed in a peripheral wall of said outside housing, wherein:

an air-supply path which is a space whose both ends on said first end side and said second end side are closed is formed between said peripheral wall of said outside housing and said peripheral wall of said inner side housing, and said third air supply opening is formed on said second end side from said second air supply opening.

9. The evaporation type burner according to claim 1, wherein:

said promotion member is constituted by a member in a shape of a plate, which has a curved surface shape whose central part is convex to said first end side, and said impregnation member is also constituted by a member in a shape of a plate, which has a curved surface shape whose central part is convex to said first end side.

10. The evaporation type burner according to claim 1, wherein:

said promotion member comprises a projection part which is a part extending toward said first end side, and said projection part contacts with said impregnation member.

11. The evaporation type burner according to claim 10, wherein:

said projection part is a bulge formed so as to be convex to said first end side in a part of said promotion member, and said bulge contacts with said impregnation member by fitting in a concave part formed on said second end side of said impregnation member.

12. The evaporation type burner according to claim 1, wherein:

said promotion member is constituted by a plurality of promotion elements which are a plurality of constituent elements, each of said promotion elements comprises a primary part which is a part having a shape of a plate and a support part which is a part having a shape of a pillar or column extending in a normal direction of said primary part, and is independently fixed at a predetermined position by having said support part inserted into said impregnation member, respectively, and said through-holes of said promotion member are formed of gaps between said primary parts which said plurality of said promotion elements comprise.

13. The evaporation type burner according to claim 1, wherein:

said impregnation member is constituted by a laminated body including a plurality of layers which consist of a member having a capillary structure and/or porous structure, and coarseness of a layer exposed to said first end side is finer than coarseness of a layer exposed to said second end side, among said plurality of said layers which constitute said impregnation member.

14. An evaporation type burner comprising;

a combustion chamber which is a space defined by an inner side housing that is a bottomed cylindrical container consisting of a bottom wall and a peripheral wall, an impregnation member which is a member disposed at a first end that is an end on said bottom wall side of said inner side housing in said combustion chamber and having a capillary structure and/or porous structure, a fuel supply unit configured to supply fuel to said impregnation member and impregnate said impregnation member with said fuel, and an ignition device configured to heat and ignite vapor of said fuel evaporated from said impregnation member, wherein:

said evaporation type burner further comprises a promotion member which is a member having many through-holes formed therein and being disposed a predetermined distance apart from said impregnation member on a second end side from said impregnation member in said combustion chamber, and said second end is an end opposed to said first end of said combustion chamber, said ignition device is disposed so as to be exposed to an ignition space which is a space located on the first end side from said promotion member in said combustion chamber, a first air supply opening configured such that at least a part of said first air supply opening opens into said ignition space and supplies air to said ignition space and a second air supply opening configured so as to open into a combustion space and supply air to said combustion space are formed in said peripheral wall of said inner side housing, and said combustion space is a space located on said second end side from said promotion member in said combustion chamber, said promotion member is constituted by a member in a shape of a plate, which has a curved surface shape whose central part is convex to said first end side, and said impregnation member is also constituted by a member in a shape of a plate, which has a curved surface shape whose central part is convex to said first end side.

* * * * *